US008167149B2

(12) United States Patent
Wamsley et al.

(10) Patent No.: US 8,167,149 B2
(45) **Date of Patent: *May 1, 2012**

(54) MERCHANDISE SECURITY SYSTEM

(75) Inventors: Stephen D. Wamsley, Lakewood, OH (US); Robert Gray, Brookpark, OH (US); Paul A. Mueller, Wadsworth, OH (US); Daniel J. Kump, Highland Heights, OH (US); Curtis Taylor, Chagrin Falls, OH (US); James J. Rataiczak, III, Chesterland, OH (US)

(73) Assignee: Fasteners For Retail, Inc., Twinsburg, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/107,187

(22) Filed: May 13, 2011

(65) Prior Publication Data

US 2011/0220593 A1 Sep. 15, 2011

Related U.S. Application Data

(63) Continuation of application No. 12/008,812, filed on Jan. 14, 2008.

(60) Provisional application No. 60/880,853, filed on Jan. 16, 2007, provisional application No. 60/997,789, filed on Oct. 5, 2007.

(51) Int. Cl.
*A47G 29/087* (2006.01)

(52) U.S. Cl. ..... 211/119.003

(58) Field of Classification Search ..... 211/119.003, 211/59.3, 184, 189, 4; 108/60, 61
See application file for complete search history.

(56) References Cited

U.S. PATENT DOCUMENTS 309,715 A * 12/1884 Harper ..... 221/131
1,007,753 A * 11/1911 Thorne ..... 312/271
1,284,597 A * 11/1918 Clinchy ..... 221/279
(Continued)

FOREIGN PATENT DOCUMENTS

DE 295 18 948 2/1996
(Continued)

OTHER PUBLICATIONS

International Search Report of International Application No. PCT/US2008/000489 dated May 7, 2009.

(Continued)

*Primary Examiner* — Sarah Purol
(74) *Attorney, Agent, or Firm* — Fay Sharpe LLP

(57) ABSTRACT

A merchandise security system includes a merchandise display having a first display member and a second display member vertically spaced from the first display member. At least one tile is mounted to the first display member. The at least one tile is movable between a first position blocking access to a desired column of associated merchandise stored on one of the first and second display members to a second position allowing access to the desired column of the associated merchandise. A lock member is operatively connected to the at least one tile for restricting movement of the at least one tile from its first position. The lock member is movable from the locked position where at the lock member interferes with movement from the at least one tile from its first position to an unlocked position which enables the at least one tile to be moved from its first position to its second position for allowing access to the desired column of associated merchandise.

20 Claims, 24 Drawing Sheets

U.S. PATENT DOCUMENTS 1,877,050 A * 9/1932 Ray ..... 221/260
2,362,758 A * 11/1944 Marrow et al. ..... 118/31.5
2,446,788 A * 8/1948 Rifkin ..... 62/234
2,460,396 A * 2/1949 Rifkin ..... 221/279
2,480,339 A * 8/1949 Rifkin ..... 62/62
2,492,912 A * 12/1949 Womack ..... 312/45
2,522,896 A * 9/1950 Rifkin et al. ..... 221/260
2,934,212 A * 4/1960 Jacobson ..... 211/59.3
3,804,480 A * 4/1974 Chamberlin ..... 312/117
3,923,159 A * 12/1975 Taylor et al. ..... 211/59.2
4,026,417 A * 5/1977 Streim et al. ..... 211/163
4,130,326 A * 12/1978 Hornblad ..... 312/292
4,640,560 A * 2/1987 Blum ..... 312/234.1
4,682,825 A * 7/1987 Crosslen ..... 312/42
4,762,236 A * 8/1988 Jackle et al. ..... 211/59.3
4,807,779 A * 2/1989 Clapper ..... 221/92
4,811,999 A 3/1989 Remington et al.
4,819,015 A * 4/1989 Bullivant et al. ..... 340/568.8
4,881,787 A * 11/1989 King et al. ..... 312/42
4,887,737 A * 12/1989 Adenau ..... 221/3
4,901,869 A 2/1990 Hawkinson et al.
4,915,460 A * 4/1990 Nook et al. ..... 312/138.1
D329,159 S 9/1992 Oldorf
5,229,749 A 7/1993 Yenglin
5,269,597 A * 12/1993 Yenglin et al. ..... 312/42
D346,077 S 4/1994 Weshler
5,341,945 A * 8/1994 Gibson ..... 211/184
5,392,025 A 2/1995 Figh et al.
5,450,968 A * 9/1995 Bustos ..... 211/59.2
5,464,105 A * 11/1995 Mandeltort ..... 211/184
5,665,304 A * 9/1997 Heinen et al. ..... 312/71
5,673,801 A * 10/1997 Markson ..... 211/59.3
5,797,487 A * 8/1998 Young ..... 206/308.2
5,918,954 A * 7/1999 Papadakis et al. ..... 312/126
6,047,647 A * 4/2000 Laraia, Jr. ..... 108/61
6,176,558 B1 * 1/2001 Hlade et al. ..... 312/42
6,253,954 B1 * 7/2001 Yasaka ..... 221/93
6,428,123 B1 * 8/2002 Lucht et al. ..... 312/138.1
6,502,718 B2 * 1/2003 Fitzgerald et al. ..... 221/131
6,513,667 B2 * 2/2003 Battaglia et al. ..... 211/59.2
6,655,536 B2 * 12/2003 Jo et al. ..... 211/59.3
6,749,071 B2 * 6/2004 Caterinacci ..... 211/40
6,932,226 B2 * 8/2005 Hardy ..... 211/119.003
7,063,217 B2 * 6/2006 Burke ..... 211/59.3
7,140,499 B2 * 11/2006 Burke ..... 211/59.3
7,150,365 B2 * 12/2006 Hardy et al. ..... 211/189
7,299,934 B2 * 11/2007 Hardy et al. ..... 211/59.2
7,497,341 B2 * 3/2009 Hardy et al. ..... 211/59.2
7,621,409 B2 * 11/2009 Hardy et al. ..... 211/59.3
7,661,545 B2 * 2/2010 Hardy et al. ..... 211/189
7,669,722 B2 * 3/2010 Hardy et al. ..... 211/59.2
7,828,158 B2 * 11/2010 Colelli et al. ..... 211/59.3
2002/0027115 A1 3/2002 Gay et al.
2002/0108916 A1 8/2002 Nickerson
2003/0010732 A1 1/2003 Burke
2003/0066811 A1 4/2003 Dimattio et al.
2003/0132178 A1 7/2003 Jay et al.
2003/0141265 A1 7/2003 Jo et al.
2004/0060944 A1 4/2004 Gervasi
2004/0140279 A1 7/2004 Mueller et al.
2005/0161420 A1 7/2005 Hardy et al.
2006/0180603 A1 8/2006 Eckert
2007/0029270 A1 2/2007 Hawkinson
2007/0170127 A1 7/2007 Johnson
2007/0272634 A1 11/2007 Richter et al.

FOREIGN PATENT DOCUMENTS

DE 195 29 926 A1 2/1997
DE 195 29 926 C2 7/1997
EP 1 692 977 8/2006
GB 2 135 292 8/1984
GB 2 386 116 10/2003
JP 410137082 5/1998
JP 02000287792 10/2000

OTHER PUBLICATIONS

Written Opinion of International Application No. PCT/US2008/000489 dated May 7, 2009.

International Preliminary Report on Patentability of International Application No. PCT/US2008/000489 dated Jul. 21, 2009.

* cited by examiner

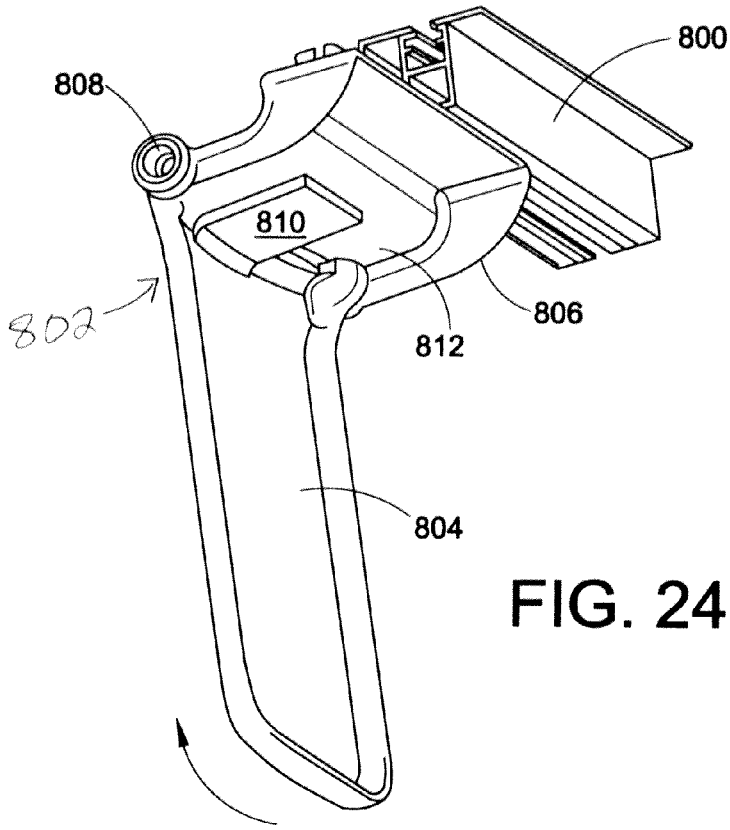
FIG. 24
FIG. 25
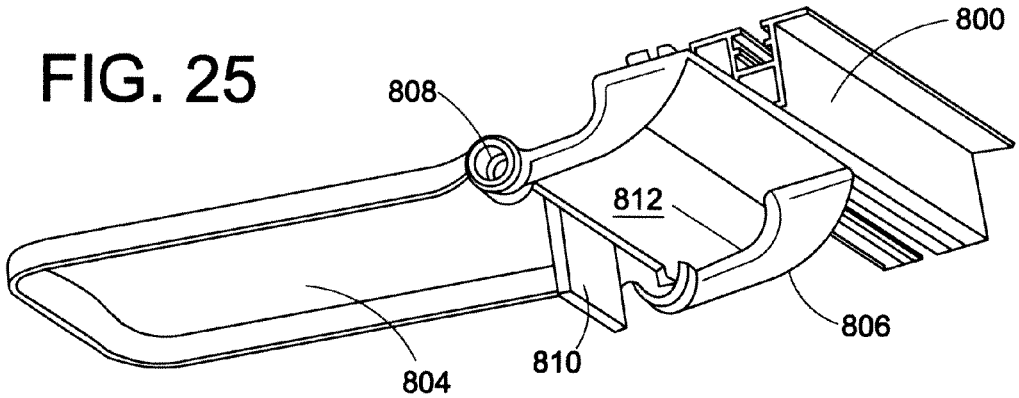

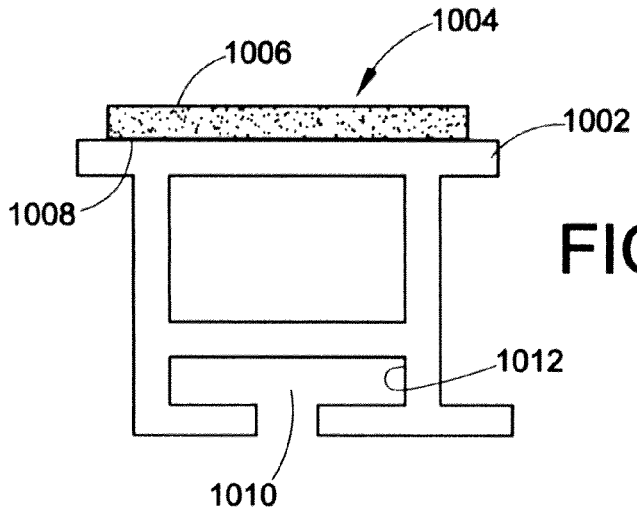
FIG. 28
FIG. 29
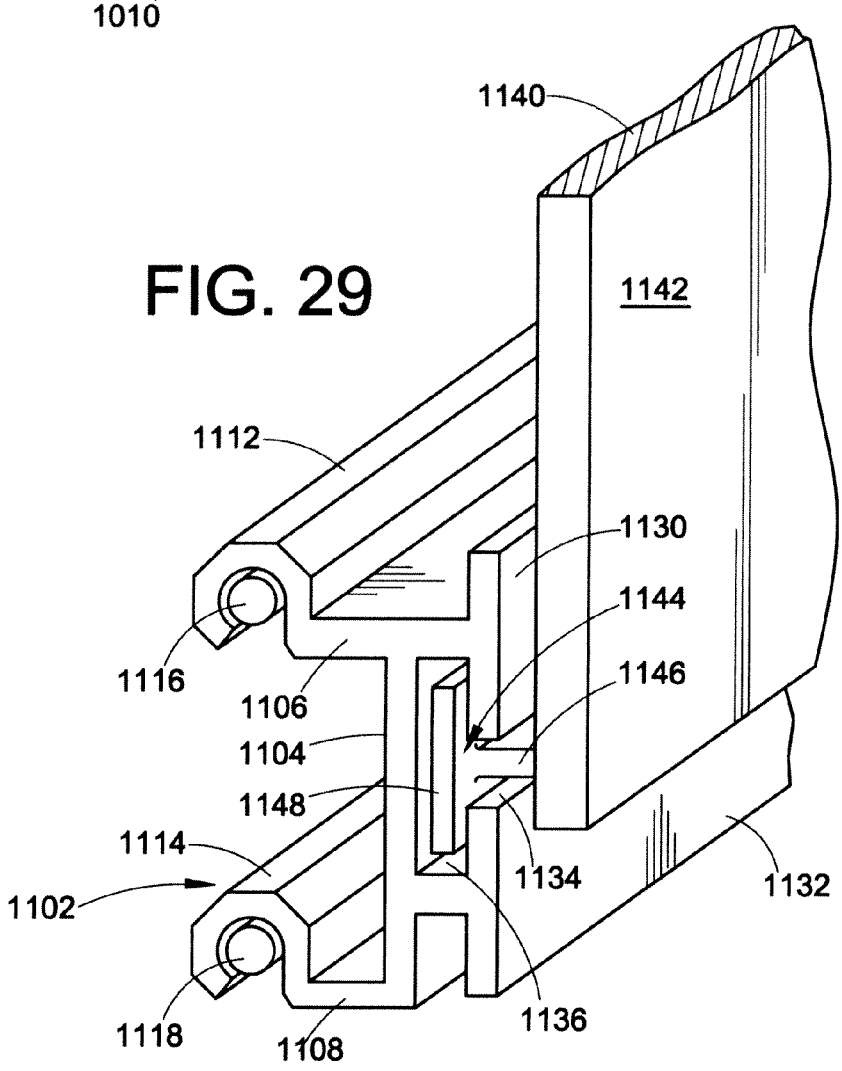

MERCHANDISE SECURITY SYSTEM

BACKGROUND

This application is a continuation application of U.S. Ser. No. 12/008,812 which was filed on Jan. 14, 2008 and is still pending. That application in turn claims priority from U.S. Ser. No. 60/880,853 which was filed on Jan. 16, 2007 and U.S. Ser. No. 60/997,789 which was filed on Oct. 5, 2007.

The present development concerns a security system employed in point of sale merchandising.

In self service retail establishments, such as drug stores, grocery stores and the like, articles are usually displayed for sale on racks consisting of vertically spaced shelves on which the articles are arranged in rows. Although merchandise in such retail environments in accessible substantially only from the front, the shelves previously employed have permitted free access to the space above the merchandise held on each shelf. In this way, a person who wished to do so could very quickly and easily remove a large number of articles at one time. It is known for thieves to "sweep" a shelf with their arm, collecting the items into a purse, bag or coat very quickly and exit a store, without drawing attention to themselves. This is particularly a problem with high value goods, such as razor blades, pharmaceuticals, batteries, cigarettes, perfumes and the like. A thief could steal as much as several hundred dollars worth of merchandise with very little effort and without great risk of being detected. Similar theft problems exist for merchandise displayed on hooks mounted on pegboards or the like.

There have been some attempts at minimizing such shoplifting losses by the expedient of partially blocking access to display shelves to prevent a mass removal of articles from the shelves, but, nevertheless, permitting removal of individual articles by a shopper.

One attempt to minimize pilferage of merchandise was by installing a transparent panel in front of each stocked shelf, but blocking access to all but a few of the articles on the shelf. However, if the panel is securely fixed in place on the rack or shelf, the panel also prevents or impedes a restocking of the shelves. Considering the value of a clerk's time, such a security system may cost more in terms of personnel time than the money it saves in reducing theft. On the other hand, if the panel is easily removed or readily moved out of the way, that is, if the manipulations needed for moving the panel out of the way are readily apparent from inspection, then the panel has little value as a security device. Another important consideration is that the security device should be inexpensive and be capable of quick and easy installation.

One attempt to solve the theft problem has been the use of dispensing display cabinets which can be stocked through a lockable door at the rear of the cabinet. Such an arrangement, however, is unsuitable for the shelving commonly used in retail establishments, as well as for peg board displays similarly used in such establishments. Another attempt, as shown in U.S. Pat. No. 4,807,779, employs a transparent front wall which leaves the bottom row of product exposed, together with a sliding door that has a pair of spaced access openings, each affording access to one row of product. While this is an adequate solution for the problem of theft, this design necessitates the provision of a separate size of display unit for each size of goods meant to be sold. For every type of merchandise having another shape or configuration, a different size of door and/or opening would be necessary.

Another design employs a hood or cover which can be mounted above a row of product, so as to impede a thief's ability to grab more than one product at a time from a row of products. However, with this design, a separate such member is necessary for each row of product on each shelf. Moreover, the member is only engageable with a particular type of display unit, in this case, one mounted on a rectangular bar. Such a design is illustrated in U.S. Pat. No. 5,665,304.

Still another design employs a pair of retaining walls, wherein a first retaining wall is shorter in height than is a second retaining wall. This design, illustrated in U.S. Patent Publication 2005/0161420, is said to result in limiting access to product and inhibiting the removal of numerous products at one time. As with the previous design, however, this design necessitates the use of separate second barriers for each row of products and the second barriers may impede access to products more than customers are willing to put up with.

It would be desirable to provide a merchandise security system which will inhibit access to a shelf or pegboard display in such a way as to retard the ability of a thief to "sweep" the shelf or pegboard display. At the same time, the merchandise should be accessible to shoppers to allow the legitimate purchase of products. Also, the shelf or pegboard display needs to be accessible to store personnel to allow a restocking of merchandise in a row of the shelf or on a pegboard hook in a prompt and efficient manner.

Accordingly, there is a need for a new and improved shelf security device or system which overcomes certain difficulties with prior art designs, while providing better and more advantageous overall results.

BRIEF DESCRIPTION OF THE INVENTION

In one embodiment, there is disclosed a merchandise security system comprising a rail adapted to be secured to a first associated merchandising structure. The rail comprises a first longitudinally extending channel. At least one tile is mounted to the rail. The at least one tile extends away from the rail so as to approach a second associated merchandising structure spaced from the first associated merchandising structure. The at least one tile comprises a protrusion which is accommodated in the rail first channel to enable a sliding movement of the tile in relation to the rail thereby allowing selective access to any desired portion of at least one of the first and second associated merchandising structures.

In accordance with another embodiment, the present disclosure pertains to a merchandise security system comprising a merchandise display and a rail adapted to be secured to the merchandise display. The rail comprises a first longitudinally extending channel. A plurality of tiles is slidably mounted to the rail. There is one less tile mounted to the rail than a number of columns of associated merchandise held by the merchandise display so that substantially one column of merchandise is accessible to a purchaser at a time and any desired column of merchandise is accessible by a suitable sliding movement of the tiles.

In accordance with still another embodiment, the present disclosure pertains to a merchandise security system comprising a merchandise display comprising a first shelf and a second shelf located beneath the first shelf. A rail is mounted to the first shelf and a plurality of tiles are slidably mounted to the rail. The tiles depend from the rail such that they extend toward the second shelf, wherein one less tile is mounted to the rail than a number of columns of associated merchandise supported by the second shelf forming an opening through which one column of associated merchandise is accessible at a time. Any desired column of associated merchandise is accessible by a suitable sliding movement of the tiles.

In accordance with a further embodiment, the present disclosure pertains to a merchandise security system comprising a merchandise display, including a first display member and a second display member spaced from the first display member. A rail is mounted to the first display member. A plurality of tiles are slidably engaged with the first rail, wherein the plurality of tiles extend toward the second display member and selectively allow access to a desired column of associated merchandise stored on one of the first and second display members.

BRIEF DESCRIPTION OF THE DRAWINGS

The present invention may take physical form in certain parts and arrangements of parts, several embodiments of which will be described in detail in this specification and illustrated in the accompanying drawings which form a part hereof and wherein:

FIG. 24 is a perspective view of a sliding tile security system according to a sixth embodiment of the present disclosure in a first orientation thereof; and, FIG. 25 is a perspective view of the sliding tile security system of FIG. 24 in a second orientation thereof;

FIG. 28 is an end elevational view of a rail which can be employed with several embodiments of the sliding tile security system disclosed herein;

FIG. 29 is a perspective view of an eighth embodiment of a sliding tile security system according to the present disclosure.

DETAILED DESCRIPTION

It should be understood that the description and drawings herein are merely illustrative and that various modifications and changes can be made in the structures disclosed, without departing from the present disclosure. It should also be appreciated that the various identified components of the merchandise security system discussed herein are merely terms of art and that these may vary from one manufacturer to another. Such terms should not be deemed to limit the present disclosure.

Figure 1:
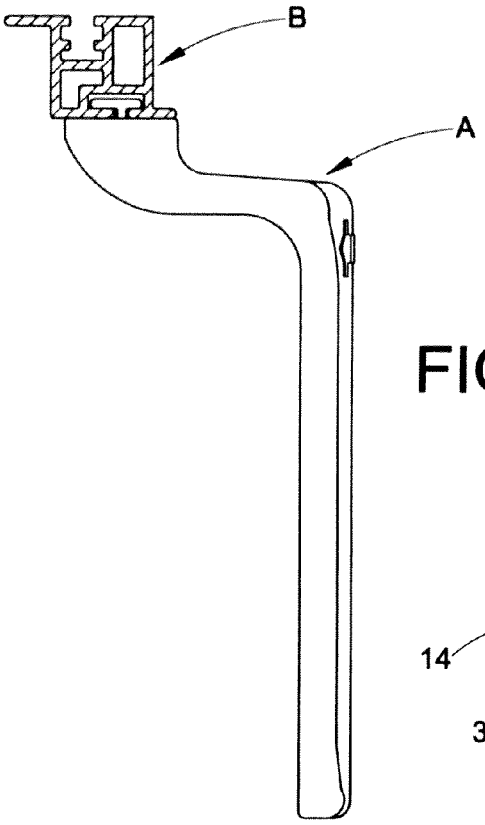
FIG. 1 is a side elevational view, partially in cross section, of components of a shelf security system according to a first embodiment of the present disclosure, before they are mounted to a shelf.

With reference now to FIG. 1, a first embodiment of the disclosure includes a tile or a relatively thin, somewhat flat and wide, blocking member or shopper access retarding element A which is slidably supported in a mounting channel or rail B. The tile or blocking member is meant to retard access to merchandise held in a display until the tile is slid out of the way. A set of such tiles can be mounted in a row in front of a merchandise display member.

Figure 2:
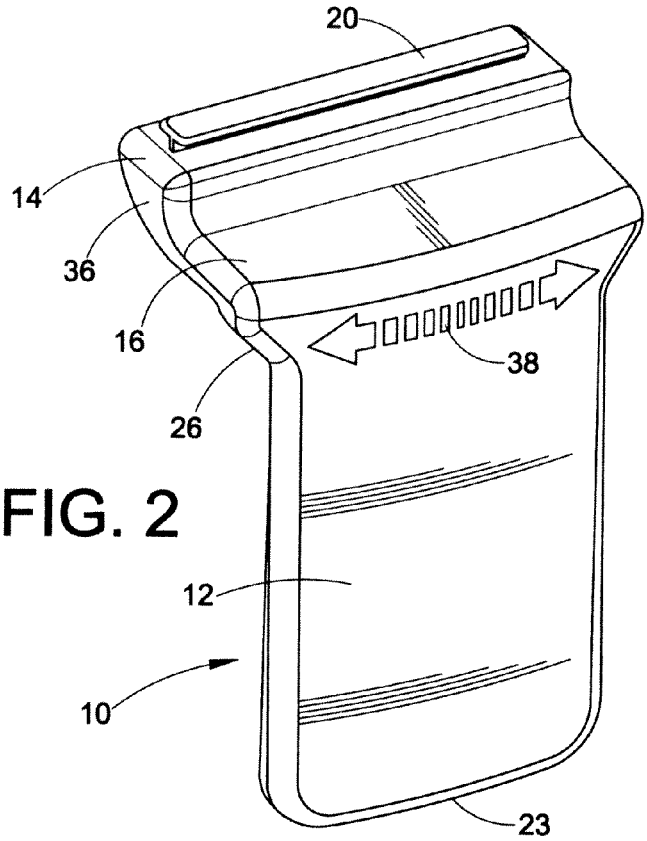
FIG. 2 is a perspective view of a tile of the shelf security system of FIG. 1.
Figure 4:
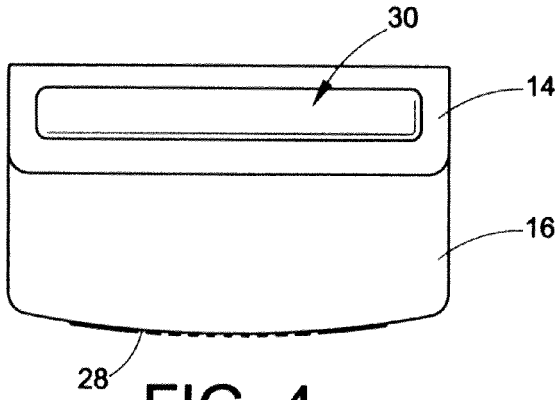
FIG. 4 is a top plan view of the tile of FIG. 2.
Figure 3:
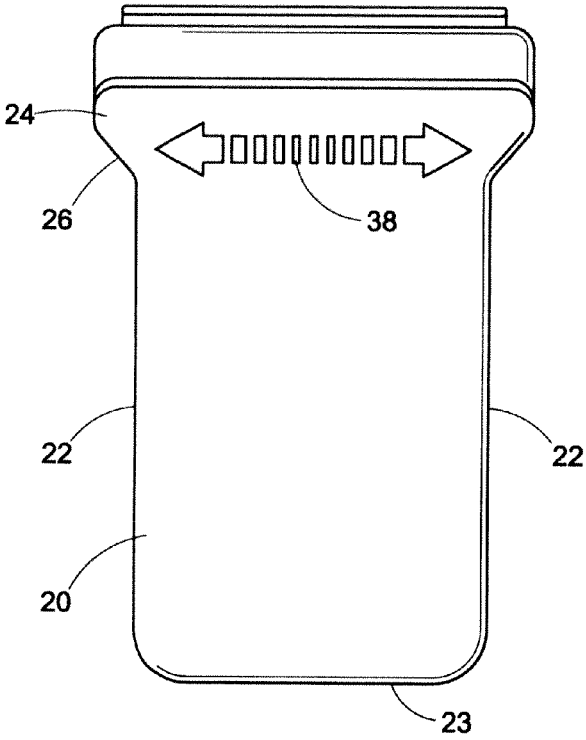
FIG. 3 is a front elevational view of the tile of FIG. 2.

With reference now to FIG. 2, the tile includes a body 10 comprising a front wall 12, a top wall 14 and a connecting portion 16 extending therebetween. As is evident, the front wall 12 is oriented approximately transverse to the top wall 14. In this embodiment, the connecting portion 16 serves to join the top wall 14 to the front wall 12. It is evident from FIG. 1 that the connecting portion 16 allows the front wall 12 to be displaced forwardly of the top wall 14. With reference now also to FIG. 3, the front wall includes a lower section 20 defined by a pair of sidewalls 22 and a base wall or bottom edge 23. It also includes an upper section 24, which is wider than the lower section 20. A pair of shoulders 26 are defined at the junction between the upper section 24 and the lower section 20. The reason for this difference in width is for ease of handling by shoppers during movement of the tiles, as will be discussed in detail below. As is best seen in FIG. 4, the front wall 12 can be convex or somewhat curved, as identified by the numeral 28. The purpose for curving the tile front wall is to improve its strength or stiffness during handling by shoppers. Of course, the front wall could be concave, as well as convex. Moreover, it could be flat.

Figure 5:
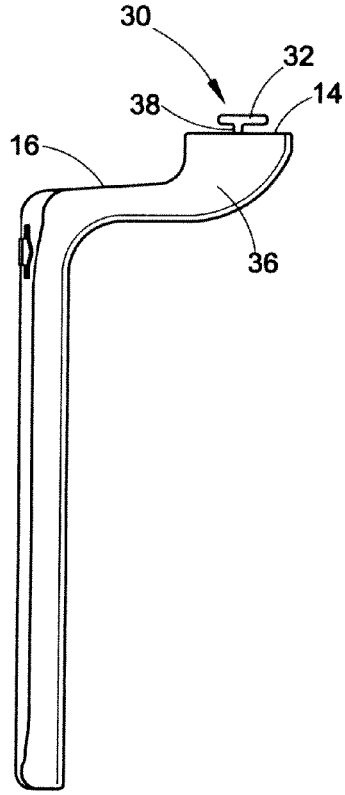
FIG. 5 is a right side elevational view of the tile of FIG. 2.

With reference now to FIG. 5, extending away from the top wall 14 is a tab 30. The tab can be somewhat T-shaped and comprises a planar portion 32 and a stem 34 which connects the planar portion to the top wall 14. As best seen from FIG. 2, a side wall 36 can extend between the top wall 14 and the connecting portion 16. It should be evident from a comparison of FIGS. 2 and 5 that a side wall 36 can be provided on both sides of the tile A. If desired, one or more indicia 38 (see FIG. 3) can be provided on the front wall 12. The indicia may be used to illustrate the two directions in which the tile can be moved or slid in relation to the support rail B. The tile can be made from a suitable known plastic material, such as by injection molding. In one embodiment, the tile or blocking member is transparent so that items of merchandise held on a shelf behind it remain visible.

Figure 6:
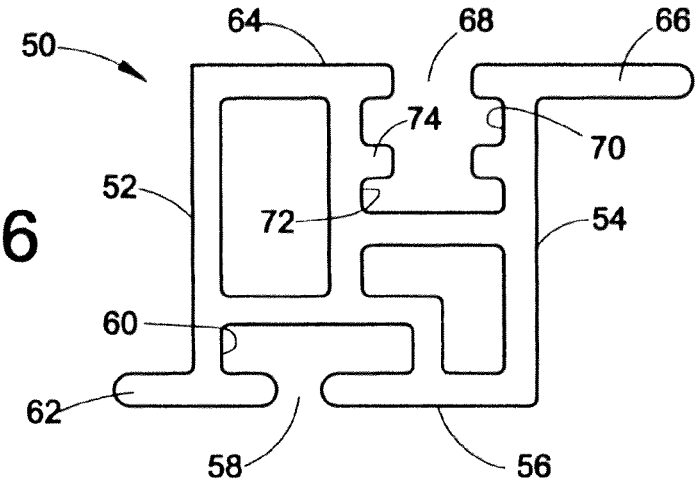
FIG. 6 is an enlarged end elevational view of a mounting channel of the shelf security system of FIG. 1.
Figure 7:
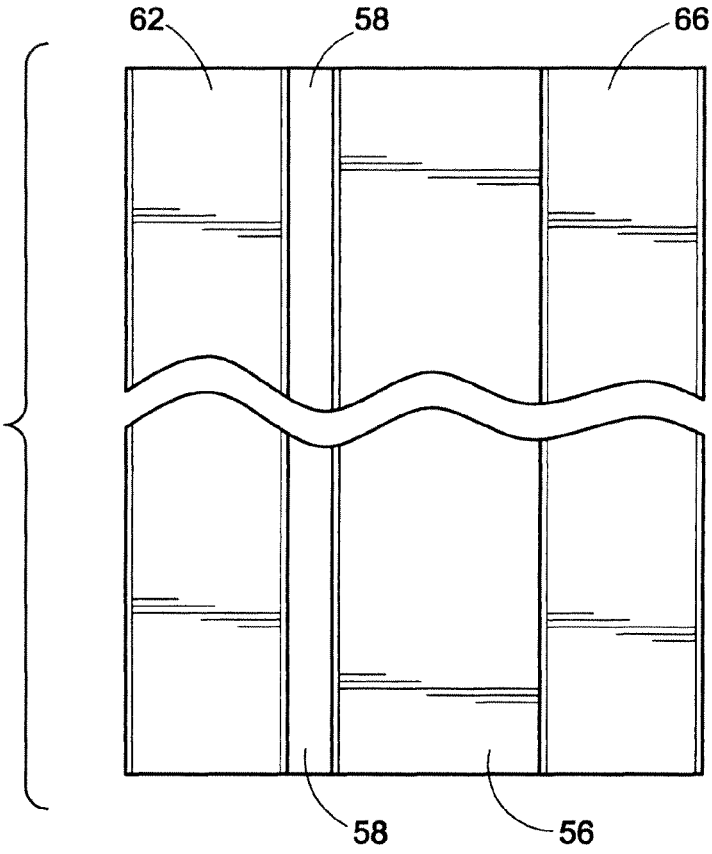
FIG. 7 is a bottom plan view of the mounting channel of FIG. 6 with a central section thereof broken away.

With reference now to FIG. 6, the support rail B can comprise a body 50 having a first side wall 52, a second side wall 54 and a base wall 56 extending therebetween. The base wall can include a first slot 58 leading to a first channel 60 defined in the support rail. As shown in FIG. 7, the first slot 58 can extend longitudinally along the entire length of the support rail B, as can the first channel 60. Of course, other designs can also be contemplated where the slot 58 and the channel 60 do not extend along the full length of the support rail B. If desired, the bottom wall can be provided with a flange 62. Also provided is a top wall 64 which extends between the pair of side walls 52 and 54. A second slot 68 can extend longitudinally in the top wall 64. The second slot can lead to a second channel 70, as well as a third channel 72 defined in the support rail B. The third channel 72 is separated from the second channel 70 by a pair of longitudinally extending shoulders 74. As is evident from FIG. 6, the third channel is disposed directly beneath the second channel. The two channels can extend longitudinally along the full length of the support rail B, if so desired. It should also be apparent from FIG. 6 that the first and second flanges 62 and 66 are disposed on opposed corners of the support rail B. Of course, other designs are also contemplated. The rail can be made of a known suitable plastic, such as a thermoplastic extrusion, or metal, such as an aluminum extrusion.

Figure 8:
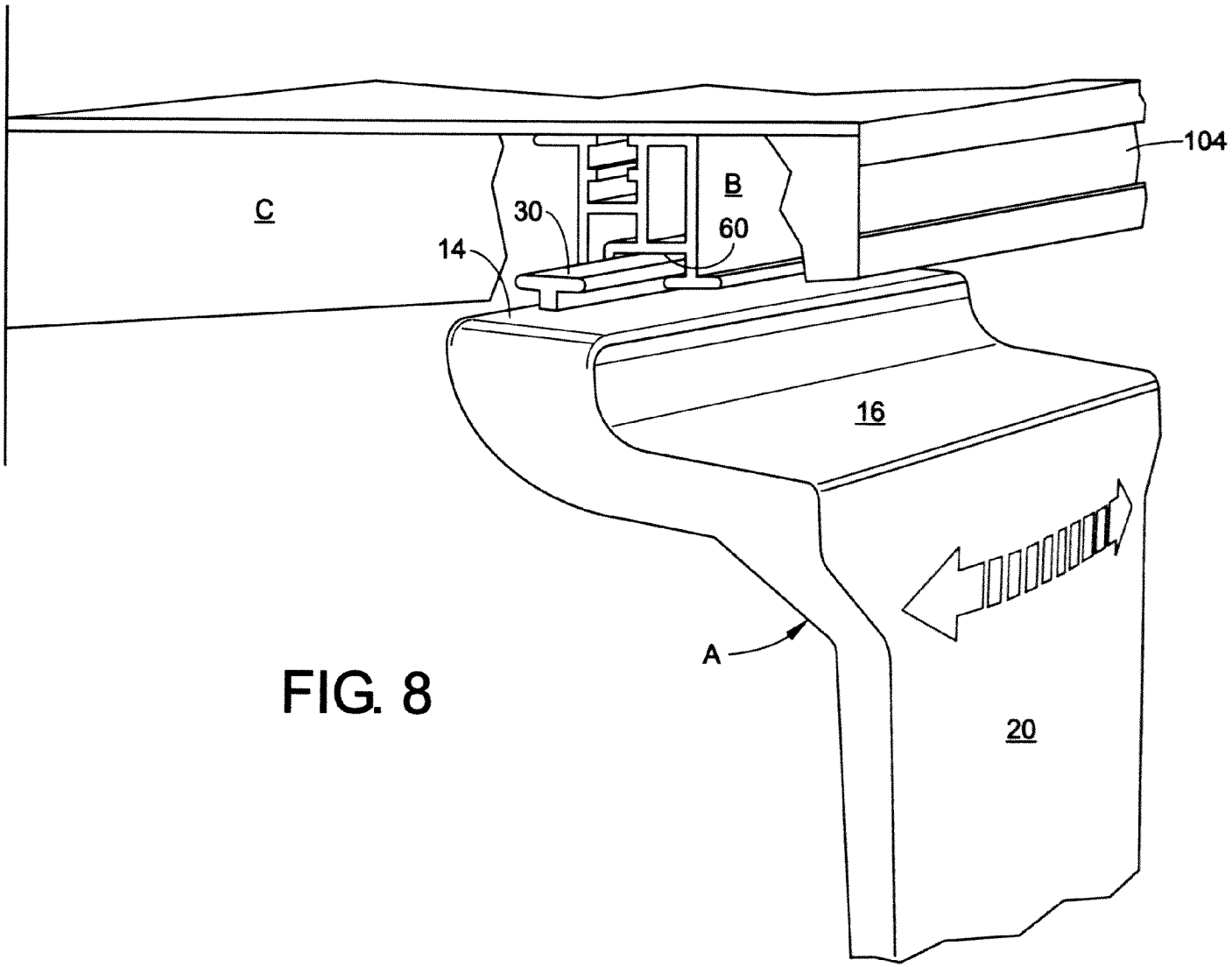
FIG. 8 is an enlarged perspective view of a portion of the shelf security system of FIG. 1 in the process of being installed on a shelf with a part of the shelf broken away for clarity.

With reference now to FIG. 8, the tab 30 of the tile A is shown in the process of being slid into the first channel 60 of the support rail B. In turn, the support rail is shown as being located beneath a merchandising structure or display member. In this embodiment, the merchandising structure is shown in the form of a shelf C. Of course, other types of known merchandising structures or display members are also contemplated.

Figure 9:
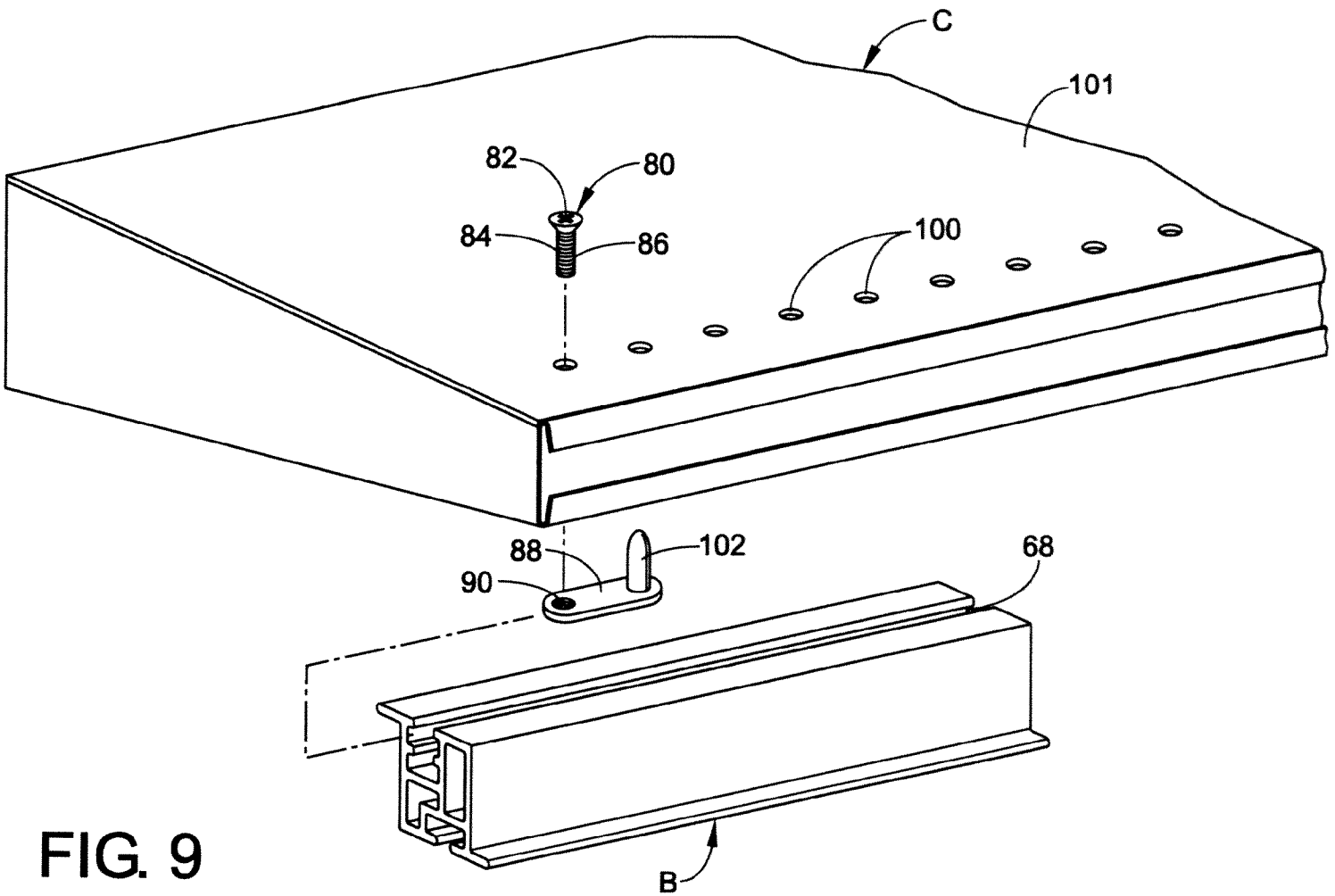
FIG. 9 is an exploded perspective view of the shelf security system of FIG. 8 in the process of being installed on a shelf.

With reference now to FIG. 9, a fastener 80 is employed in order to secure the support rail B to the shelf C. To this end, the fastener 80 comprises a head 82 and a stem 84 extending therefrom. A suitable conventional threading 86 can be provided on the stem. The stem of the fastener can cooperate with a nut 88 which includes a threaded aperture 90 through which the stem 84 of the fastener can extend. The nut 88 is so designed that it can be slid into the second channel 70 of the support body 50. In order to more easily locate the nut 88 in relation to a set of apertures 100 extending through a shelf top surface 101, there is provided a locating stem 102 on the nut 88. The locating stem is so positioned on the nut 88, in relation to the aperture 90, as to match the distance between adjacent apertures 100 on the shelf 101. Thus, when the stem 102 extends through one aperture 100, the aperture 90 of the nut 88 is aligned with another aperture 100 of the shelf C. In this way, the fastener 80 can be more easily secured to the nut 88. The portion of the fastener stem 84 located beneath the nut 88 extends into the third channel 72 of the body 50. It should be recognized that the shape of the nut 88 can be altered as may be desirable. Generally, the physical construction of the nut should be such as to allow it to cooperate with the slot formed in the support rail. It should also be recognized that other known connecting arrangements could be employed to secure the support rail B to the shelf C.

Figure 10:
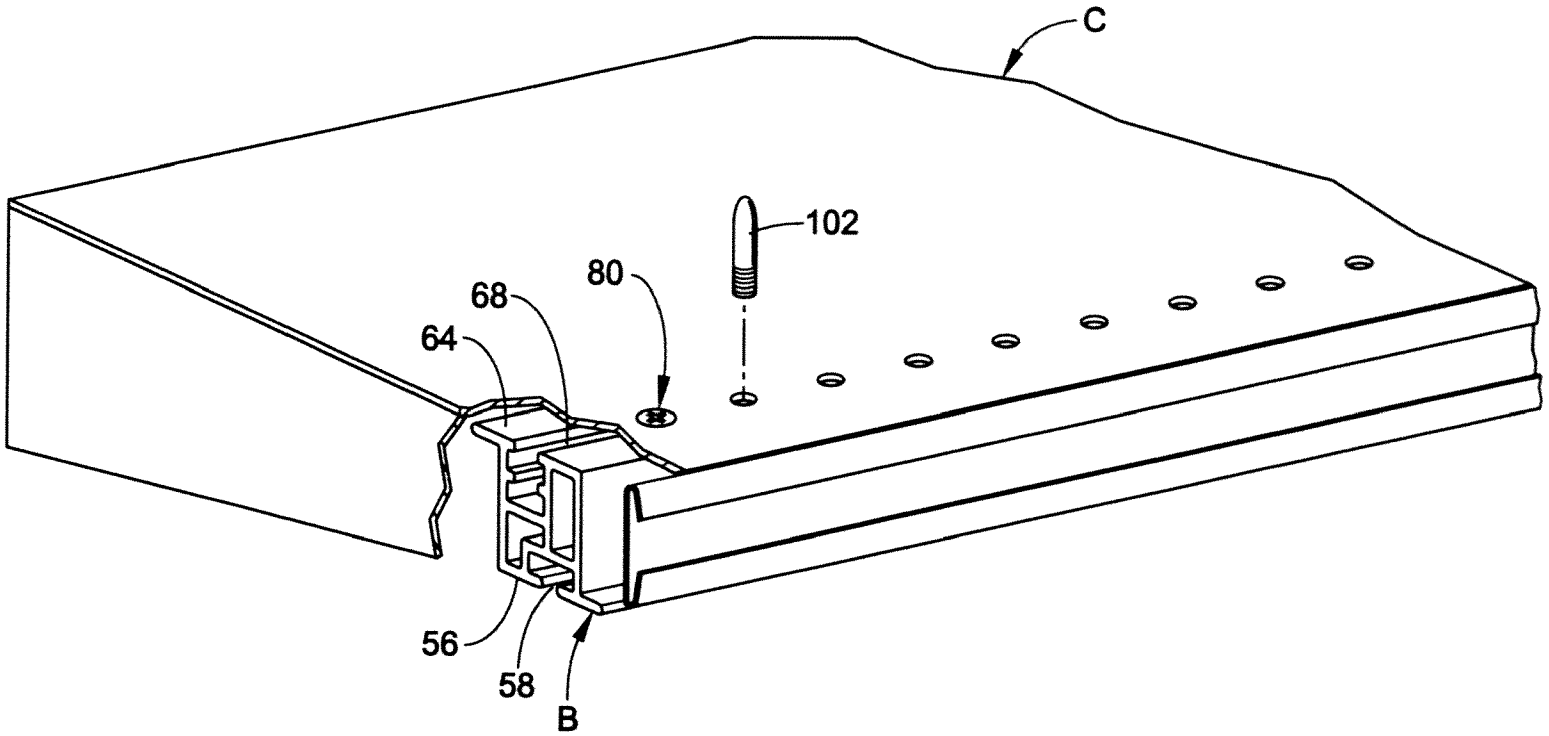
FIG. 10 is a perspective view of the shelf security system after it has been installed on a shelf, with a part of the shelf broken away for clarity.

With reference now to FIG. 10, the fastener 80 extends through an aperture 100 defined in a shelf top surface 101. Many conventional shelves have an array of such apertures 100 located at regular intervals, as shown in FIG. 10. As the head of the fastener abuts the shelf top surface and the fastener is further rotated, the nut 88 is pulled up against the support rail top wall 64. This in turn pulls the support rail up against a bottom surface of the shelf C, thus securing the support rail in place. Once the support rail B has been fastened to the shelf C, the locating stem 102 can be detached from the nut and removed, as shown. In other words, the major purpose for the locating stem in this embodiment is to serve as a locating means for the nut and the fastener. Of course, other means for securing the rail B to the shelf C are also contemplated.

While only one fastener is illustrated in FIG. 10, it should be appreciated that any suitable number of such fasteners can be employed in order to securely mount the support rail B in place on the shelf C. It is contemplated that at least several such fasteners would be employed in order to mount the support rail B to the shelf C. In one embodiment, the tiles A can be premounted on the support rail B before the support rail is fastened to the shelf C, as illustrated in FIG. 8. Alternatively, the tiles could perhaps be mounted to the support rail after it is secured in place. In either case, the tiles A are thus secured in place beneath the shelf C. It is noted that a front wall 104 of the shelf C extends downwardly by a distance which is smaller than the combined height of the support rail B and the tile connecting portion 16. As a result, the tile front wall 12 can extend forwardly of the shelf front wall 104, as is illustrated in FIG. 8.

Figure 11:
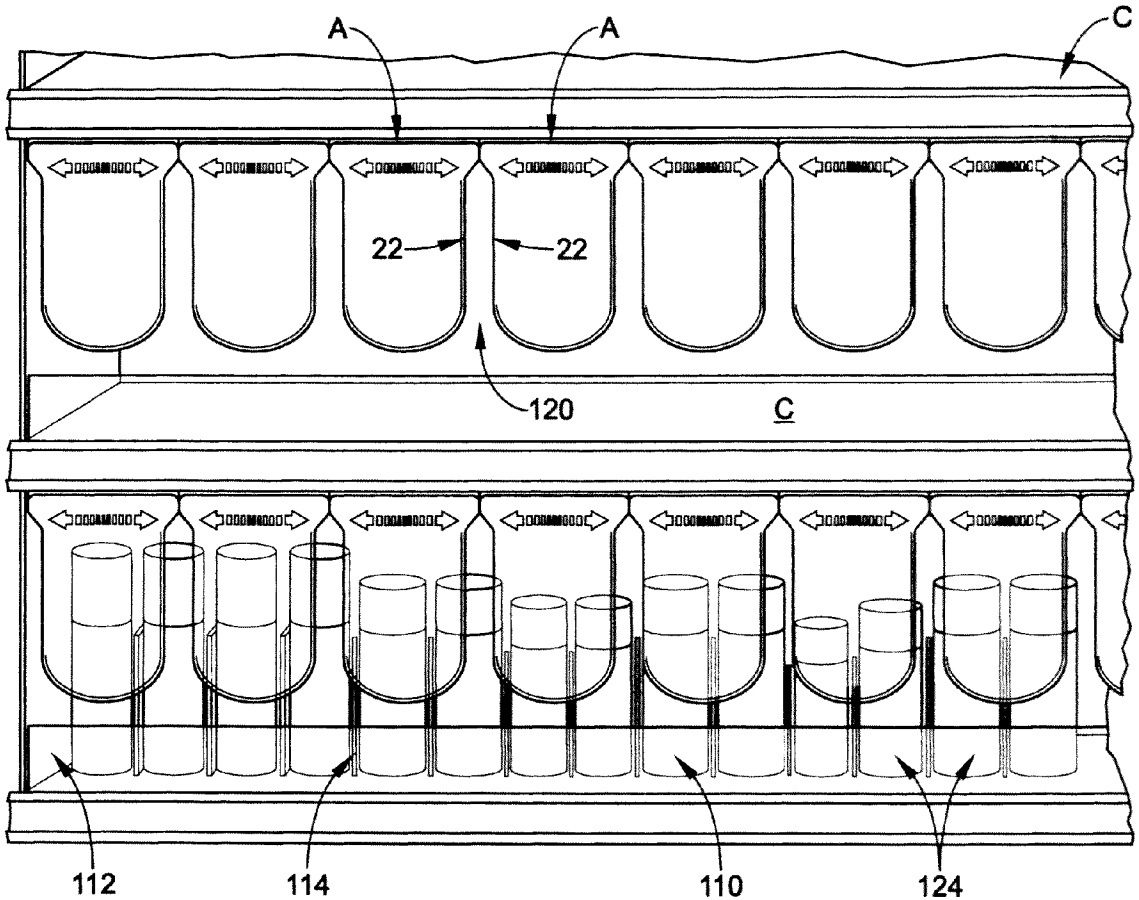
FIG. 11 is a front elevational view of the shelf security system as mounted on a merchandise display including a pair of adjacent shelves.

With reference now to FIG. 11, merchandise 110 is normally supported on a shelf. Many times a front fence 112 is employed on the shelf to prevent the merchandise from falling off the front of the shelf. Often, the merchandise is separated into columns (sometimes inaccurately termed rows) by a plurality of dividers 114. As is evident from FIG. 12, tracks 116 are often provided between the dividers 114. Flat coil springs 118 can be employed to bias pushers (not visible) to urge the merchandise toward the front fence 112. With reference again to FIG. 11, it should be evident that a slot 120 is defined between adjacent side edges 22 of two adjacent tiles A. Such slot enables a customer to place his or her fingers between the tiles in order to move or slide the tiles sideways so as to obtain access to a desired column 124 of merchandise. As mentioned, the tiles can be transparent in order to allow a customer to see what columns of merchandise are displayed behind the security tiles or blocking members.

Figure 12:
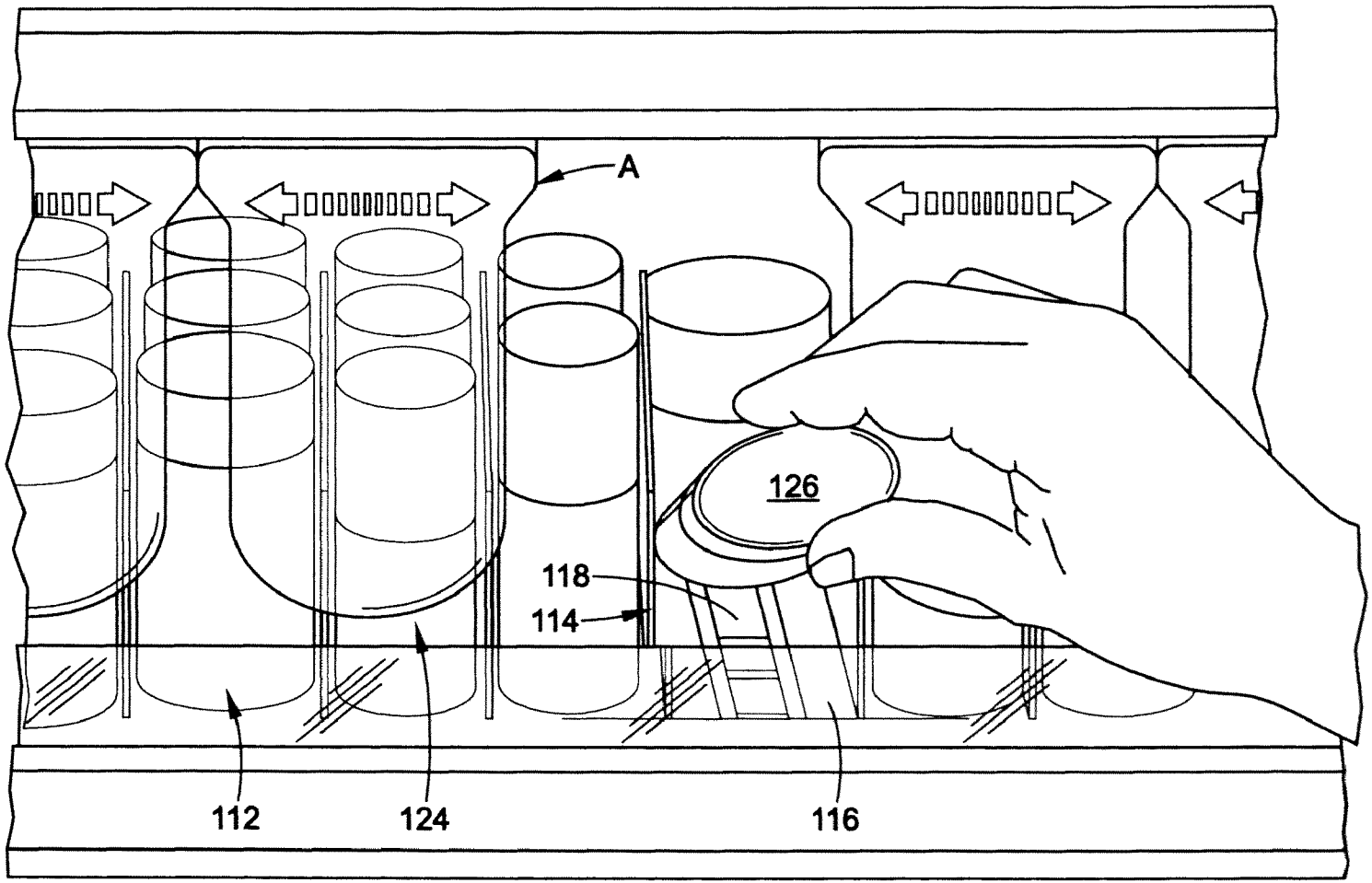
FIG. 12 is an enlarged perspective view of a product in the process of being removed from an accessible row of product on a shelf of FIG. 11.

With reference again to FIG. 12, in this manner, a customer can grasp an item of merchandise 126 and remove it from the shelf. However, adjacent columns of merchandise are generally blocked by adjacent tiles. In other words, one less tile is provided than the total number of columns of merchandise on the shelf so that only a single column of merchandise is generally accessible for withdrawal of items. FIG. 12 illustrates an embodiment in which, at most, two relatively narrow columns of merchandise adjacent each other are accessible. But other columns of merchandise cannot be reached, because of the sliding tiles in front of them. Of course, it should be recognized that the width of the merchandise being held on the shelves and the width of the tiles mounted in front of the merchandise held on the shelves will control the number of columns of merchandise which are accessible with any given design of the shelf security system disclosed herein. The tiles A can be made in any desired height, in order to accommodate the vertical spacing between adjacent shelves. That spacing is usually dictated by the height of the merchandise being displayed on the shelves. Similarly, the tiles can be made in any desired width, as may be dictated by the width of the merchandise meant to be protected from pilferage.

It should be appreciated that the tiles A cooperate with the front fence 112 to retard access to merchandise held on a shelf C. In other words, the bottom edge 23 of the tile front wall 12 does not need to approach the top wall of the subjacent shelf because the front fence retards access to a lower section of the merchandise being held on the subjacent shelf. In one embodiment, the tile front wall bottom edge 23 overlaps a top edge of the front fence 112 to completely prevent access to the merchandise, except in the narrow vertically extending slot between the tiles. In another embodiment, the bottom edge 23 only approaches the top edge of the fence 112. Even so, removal of the merchandise 126 is prevented by the positioning of the tiles A above the front fence 112. In one embodiment, the tiles A are positioned such that the tile front wall 12 is located forwardly of the fence 112.

Figure 13:
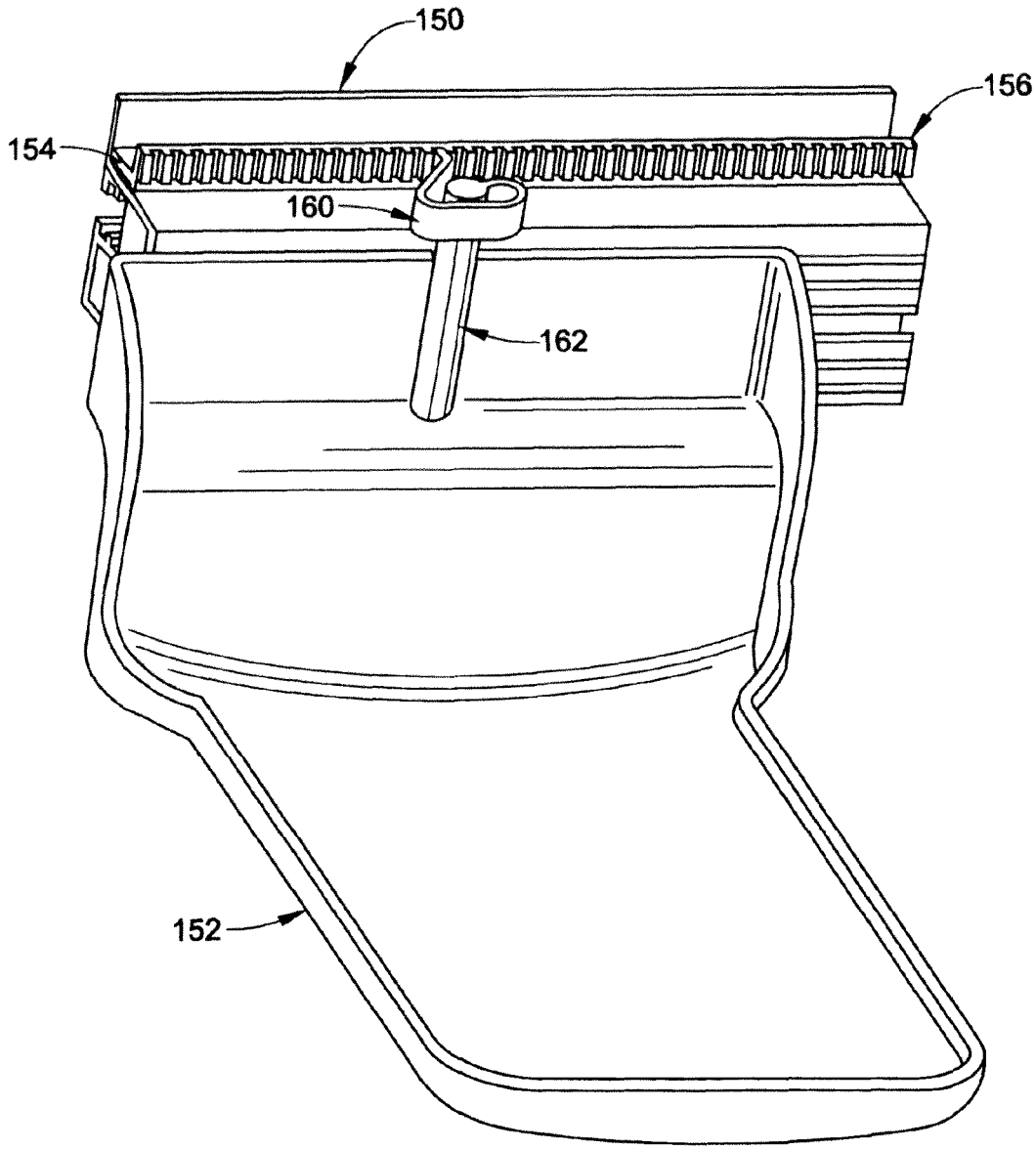
FIG. 13 is a perspective view of another design of a sliding tile security system in accordance with the present disclosure.

With reference now to FIG. 13, another embodiment of a sliding tile security system is there shown. In this design, the sliding tile security system includes a rail 150 and a tile or blocking member 152 which is slidably mounted to the rail. In this embodiment, the rail includes an elongated member 154 on which are defined a plurality of serrations or teeth 156. These are engaged by a resilient finger 160 which is supported by a pin 162. The pin itself can be mounted to the tile 152 and extend rearwardly therefrom. The reason why the finger 160 engages the serrations 156 is to provide an audible signal when the tile 152 is moved in relation to the rail 150. In other words, both the shopper and the merchant will hear any sliding movement of the tile 152 in relation to the rail 150. For some merchants, this may prove useful in alerting them to shopping activity concerning a particularly valuable product or merchandise which is being retailed behind the security system discussed herein.

Figure 14:
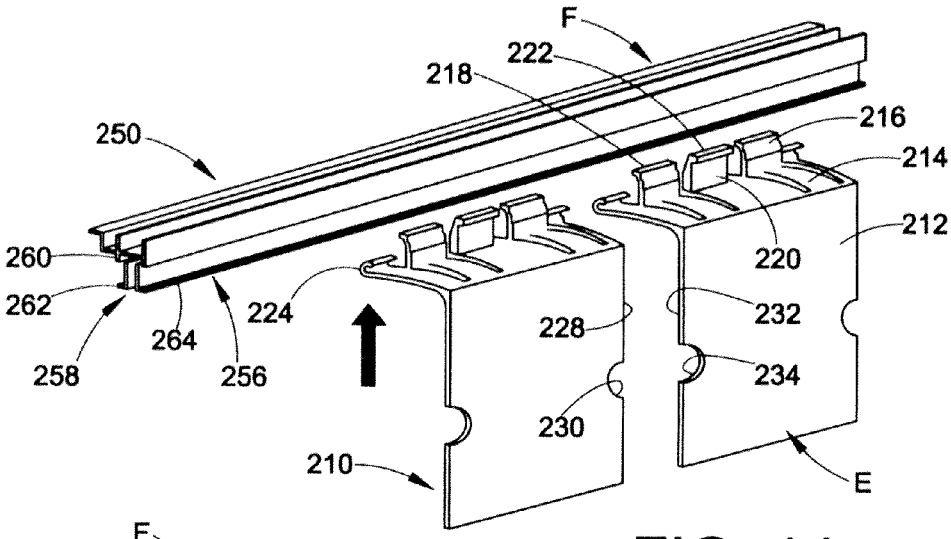
FIG. 14 is an exploded perspective view of a shelving security system according to a second embodiment of the present disclosure.
Figure 15:
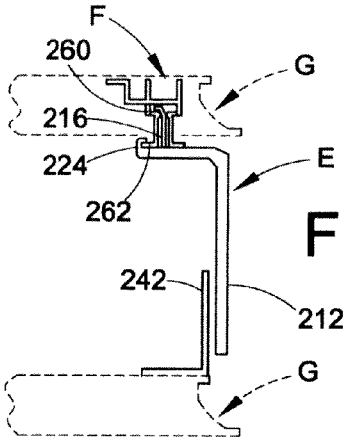
FIG. 15 is an assembled side elevational view of he shelving security system of FIG. 14.
Figure 16:
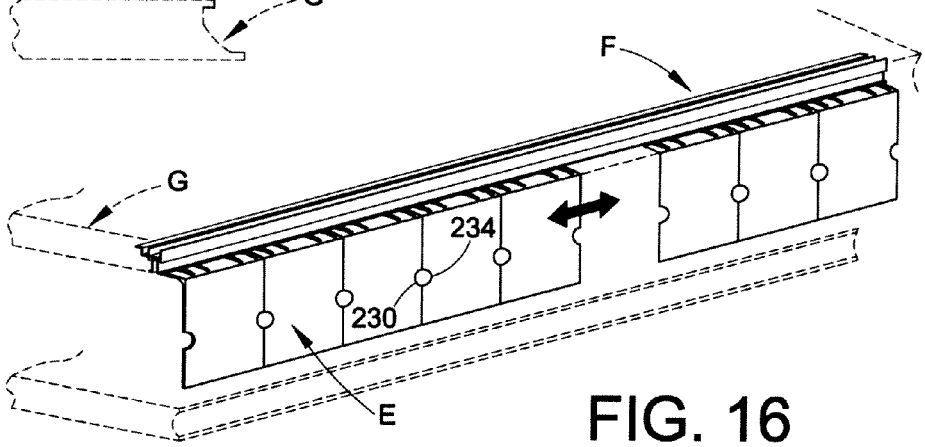
FIG. 16 is a perspective view, on a reduced scale, of the shelving security system of FIG. 14 in an assembled condition.

With reference now to FIGS. 14-16, another embodiment of the present disclosure is there illustrated. In this embodiment, there is provided a plurality of tiles E and a mounting rail or channel F. Each tile E includes a tile body 210 which comprises a front wall 212 and a top wall 214, which is oriented approximately perpendicular thereto. Extending upwardly from the top wall is a first connecting arm 216 having a sidewardly extending flange 218 and a second connecting arm 220 having a sidewardly extending flange 222. In the design illustrated in FIG. 14, three such connecting arms are illustrated. Two of the arms can be oriented rearwardly, such that the respective flanges 218 protrude rearwardly. However, the third connecting arm can face forwardly and can be positioned between the two rearwardly facing connecting arms. Also extending from the top wall 214 can be a pair of hook shaped extensions 224. In this embodiment, the tiles each include a first side wall 228 with a cut out 230 and a second side wall 232 with a cut out 234. The cut outs provide finger access to shoppers, allowing them to slide the tiles.

The second embodiment of the disclosure also includes a pair of adjacent shelves G. As with the first embodiment, a front fence 242 can be provided at the front edge of the shelf G in order to retard the possibility that merchandise will fall off the front of the shelf. In the embodiment of FIG. 15, two adjacent, vertically spaced, such shelves G are illustrated. It is noted that the tile front walls 212 are positioned in front of the front fence 242.

The tiles E are meant to slide in relation to the support rail F. In this embodiment, the rail or track F can be made of extruded aluminum. The support rail includes a body 250 comprising a bottom wall 256. A slot 258 is defined in the bottom wall. The respective flanges 218 and 222 of the connecting arms 216 and 220 are meant to be accommodated in the slot 258 so as to allow a sideward sliding motion of the tiles E with respect to the support rail F. More particularly, as is illustrated in FIG. 15, the connecting arm extends into a longitudinally extending channel 260 which is defined in the support rail F and communicates with the slot 258. As will be appreciated, the channel will accommodate the respective flanges 218 and 222. Due to the resilient nature of the thermoplastic material from which the tiles E can be made, the connecting arms 216 and 220 can flex so that the tiles can be snapped into the rail F. Thus, the tiles can be mounted to the rail after the rail is mounted to a shelf.

The support rail body 250 can include rear and front flanges 262 and 264 disposed on either side of the slot 258. The rear flange 262 cooperates with the hook shaped extension 224 of the tile. Such cooperation enables the tile E to be mounted to the support rail F in a sturdy fashion, thereby reducing the chance of the tile wobbling in relation to the support rail during use. To enable a customer to slide the tiles sidewards as desired, a customer can place a finger between two adjacent tiles via the cooperating cut outs 230 and 234, as is best illustrated in FIG. 16. In this embodiment, the front wall 212 of the sliding tiles extend in front of the front fence 242, as best illustrated in FIG. 15. With reference again to FIG. 16, the sliding tiles are meant to cover all but one section of a shelf in order to minimize access to all but one of the several columns of products being held on the shelf. However, by sliding the tiles sideways, any desired section of the shelf, and the set of products being held thereon, is accessible to a potential customer.

Figure 17:
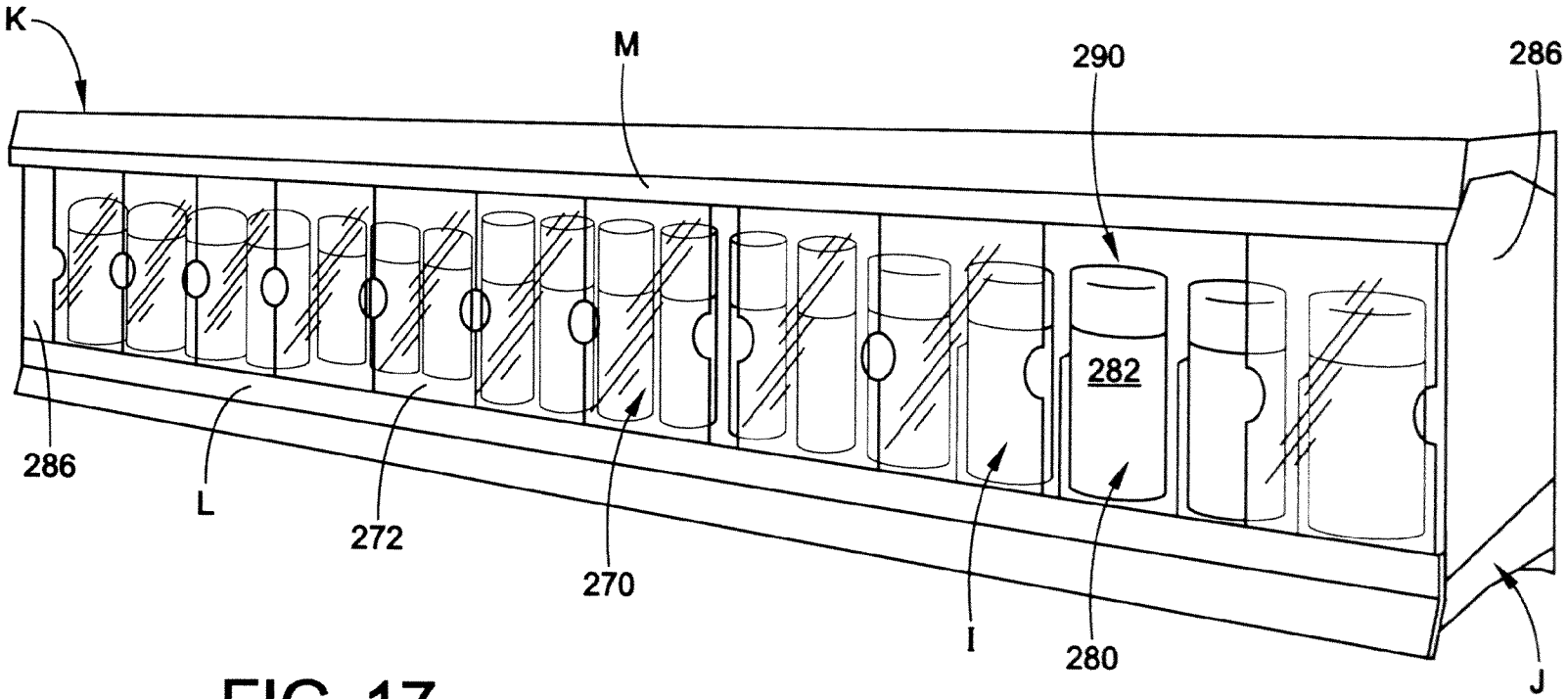
FIG. 17 is a perspective view of a shelving security system according to a third embodiment of the present disclosure.
Figure 18:
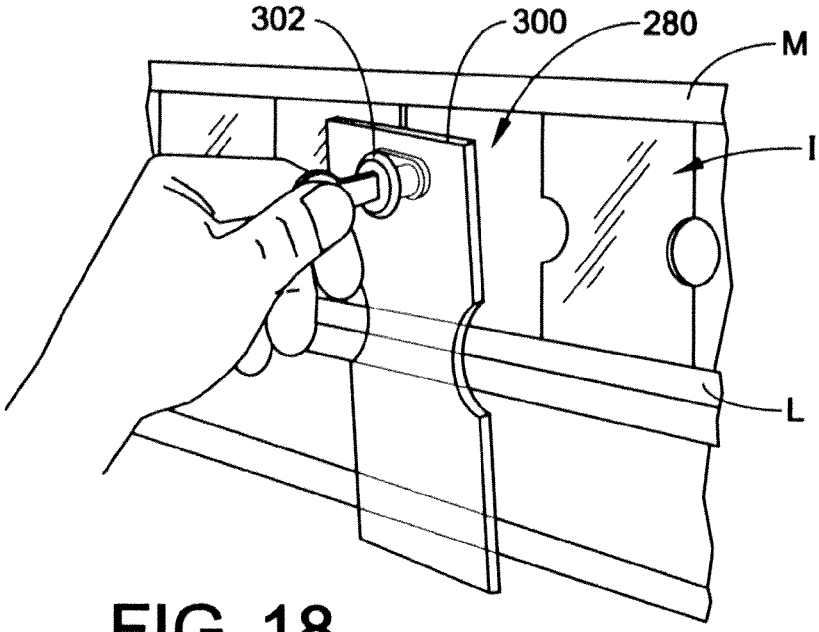
FIG. 18 is an enlarged perspective view of a locking tile usable with the shelving security system of FIG. 17.
Figure 19:
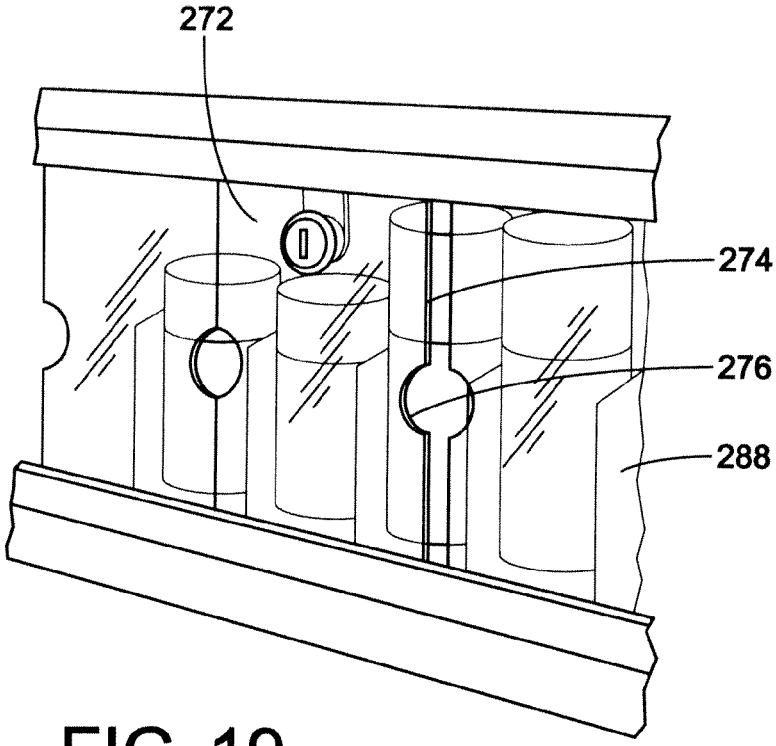
FIG. 19 is a perspective view of the locking tile as installed between a pair of adjacent tiles.

With reference now to FIGS. 17-19, a third embodiment of the disclosure is there illustrated. In this embodiment, suitable tiles I are mounted to a pair of shelves J and K via respective support rails L and M. In this embodiment, two such support rails are provided, located at the top and bottom edges of a shelf space. Therefore, in this embodiment, the tiles have suitable cooperating upper and lower connecting elements (not visible) that enable each the I to be slid sideways in relation to the shelves J and K, on lower and upper support rails L and M. The tiles I each include a body 270 having a front wall 272. With reference now to FIG. 19, the tile also includes a first side wall 274 with a cut out 276 and a similar second side wall and cut out. As is evident from FIG. 17, enough tiles are mounted across the front of each shelf so as to provide a single access opening 280 through which a product 282 can be retrieved by a customer. As the tiles are slid sideways, the access opening can move across the full width of the shelf, Also in this embodiment, suitable end closure panels 286 are provided in order to forestall access to the contents on the shelf from the sides thereof. Closing the two ends or side edges of the shelf also makes difficult the removal of the support rails by unauthorized personnel. As in the previous embodiments, a suitable front fence (not shown) can be employed to prevent the merchandise being held on the shelf from falling off the front edge of the shelf when the access opening 280 is disposed before a desired column 290 of products 282.

In this embodiment, a locking tile 300 can be installed on the security system in order to close the access opening 280 and prevent any access to a shelf of merchandise at night, or when the store is closed. The locking tile 300 can employ a keyed lock 302 in order to selectively secure the locking tile in place over the access opening 280 defined between a pair of spaced tiles. Of course, such keyed locks are well known in the art.

Figure 20:
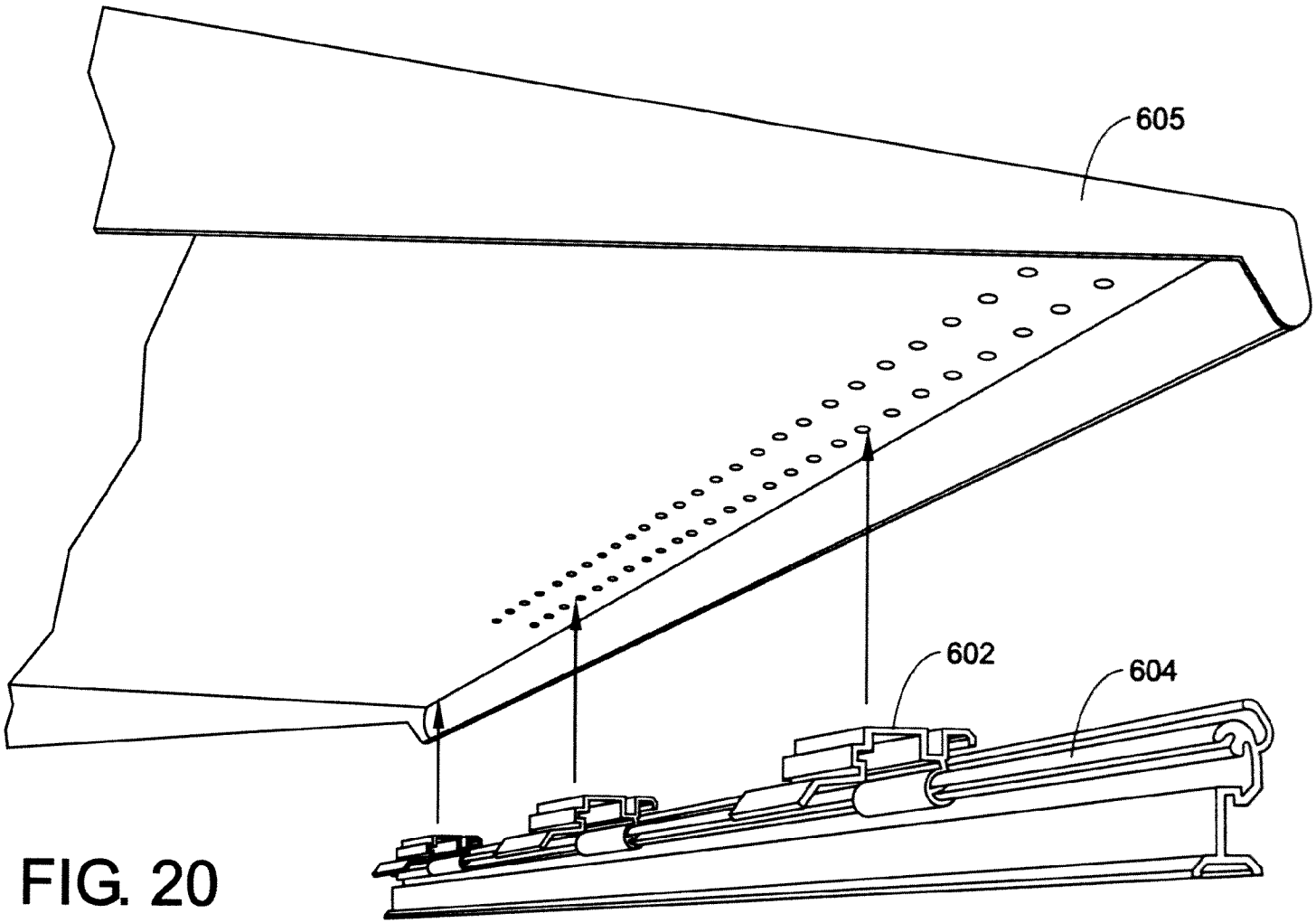
FIG. 20 is a perspective view of a portion of a sliding tile security system according to a fourth embodiment of the present disclosure.
Figure 21:
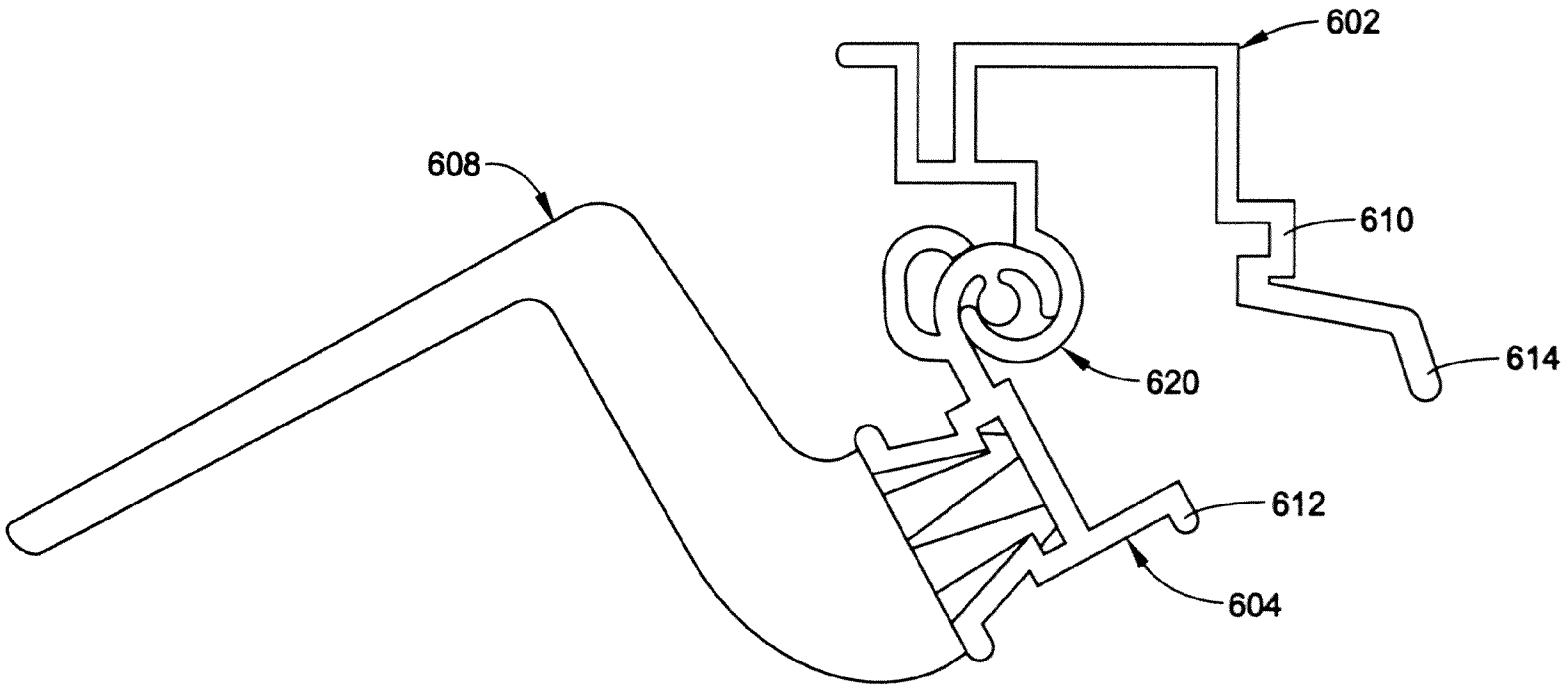
FIG. 21 is an enlarged view of a portion of the system of FIG. 20.
Figure 22:
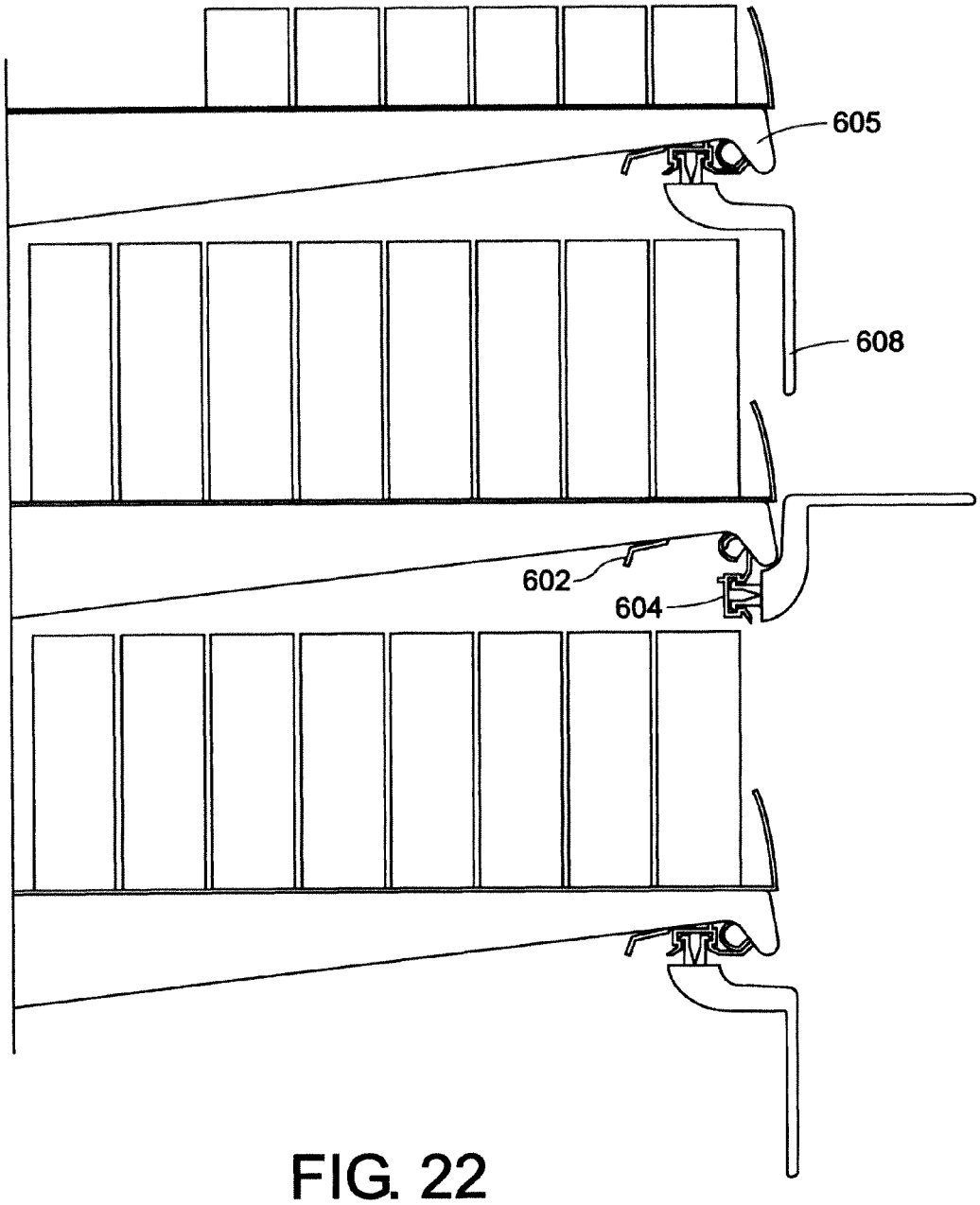
FIG. 22 is a side elevational view of the sliding tile security system of FIG. 21.

With reference now to FIGS. 20-22, a further embodiment of a merchandise security system is there illustrated. In this embodiment, a connector construction in the form of one or more slide snap modules 602 is mounted to an extrusion or rail 604 in any conventional manner. These are fastened to an underside of a shelf 605 via suitable fasteners (not shown). Tiles 608 are mounted to the rail 604. With reference to FIG. 22, due to the presence of the side snap modules 602, the entire rail 604 can be pivoted forwardly out of the way in order to allow restocking of the shelf being protected by the tiles. In normal use, the tiles can be slid sideways in order to obtain access to products held on the shelf. With reference now to FIG. 21, it can be seen that the rail 604 can pivot in relation to the slide snap modules 602. This can occur when a channel 610 of the module 602 no longer holds a flange 612 of the rail 604. In order to unlock the rail 604, an arm 614 of the module 602 is pulled rearwardly. Due to the resilient nature of the material from which the connector or module 602 is made, it can be pulled rearwardly so as to free the flange 612 from the channel 610. At this point, the rail 604 can pivot in relation to the module 602 around a hinge joint 620 defined between them. Subsequently, the rail 604 can again be locked to the module 602 in a use position via the cooperation of the flange 612 with the channel 610.

Figure 23:
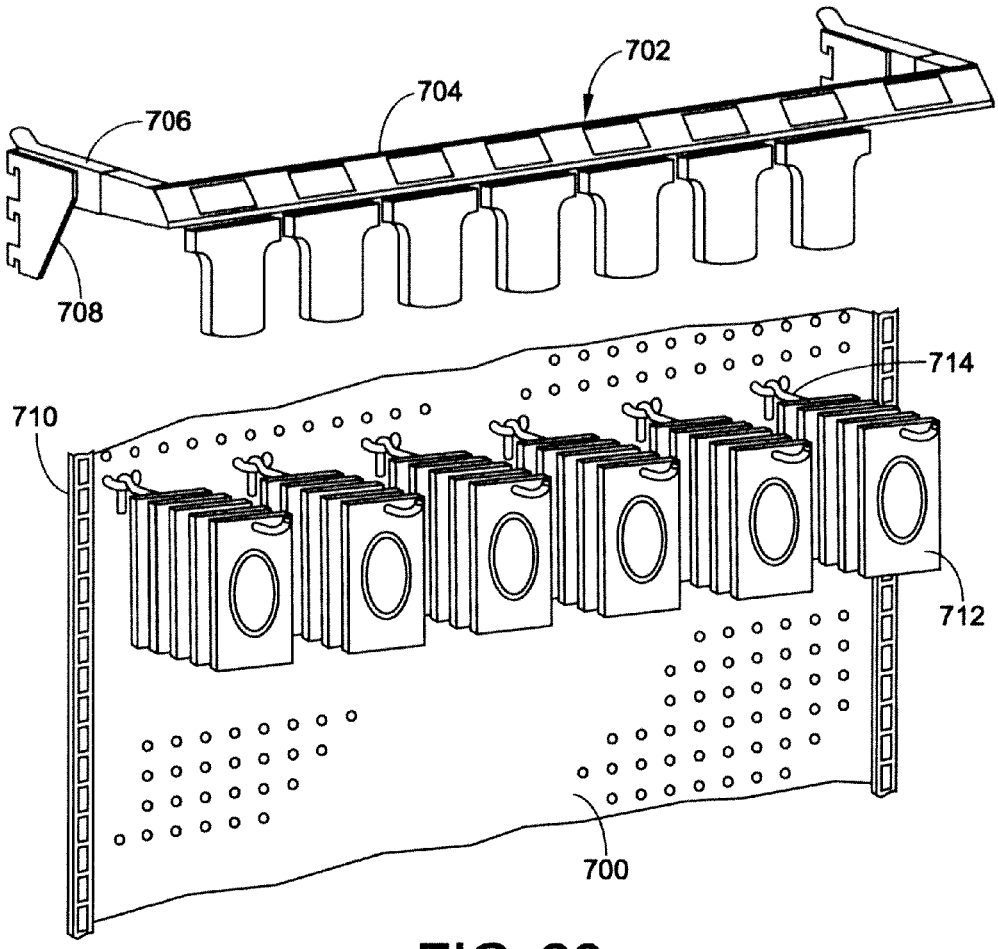
FIG. 23 is a perspective view of a sliding tile security system according to a fifth embodiment of the present disclosure.

With reference now to FIG. 23, a still further embodiment of a sliding tile security system is there shown. This system is adapted for use on peg boards such as at 700. A mounting system 702 for the sliding tiles includes a front rail or support section 704, as well as telescoping side sections 706 and respective connector elements 708. The connector elements 708 enable the mounting system 702 to be connected to risers 710 located on either side of the peg board 700. As in the earlier embodiments, the tiles are slid sideways in order to allow access to a column (sometimes called row) of product 712 being held on a mounting hook 714, which is selectively secured to the peg board 700. With telescoping side sections 706, the front rail can be positioned as desired so that the tiles are located in front of the merchandise 712 held by the hooks 714.

With reference now to FIGS. 24 and 25, still another embodiment of the present disclosure is there illustrated. In this embodiment, a rail 800 has slidably mounted thereto a tile 802. The tile 802 comprises a first section 804 which can be substantially vertically oriented in one end position and a second section 806 which is approximately horizontally oriented. These two sections are connected by a hinge 808. The tile first section 804 can thus be rotated in relation to the tile second section 806. More particularly, the tile first section 804 can be rotated forwardly or clockwise in FIG. 24 in relation to the tile second section 806, as shown by the arrow. The purpose for such rotation is to allow access to products being held in a merchandise display behind the tile. It should be noted that while the tile can be rotated forward or clockwise, as illustrated in FIG. 25, it cannot be rotated backward. To prevent such counterclockwise or backwards rotation, a blocking arm 810 extends from a rear surface of the tile first section 804. The blocking arm 810 abuts a bottom surface 812 of the tile second section 806 to prevent a rearward rotation of the tile first section 804. As in the previous embodiments, the tile 802 is slidable in relation to the rail 800 via cooperating elements engaging the two.

Figure 26:
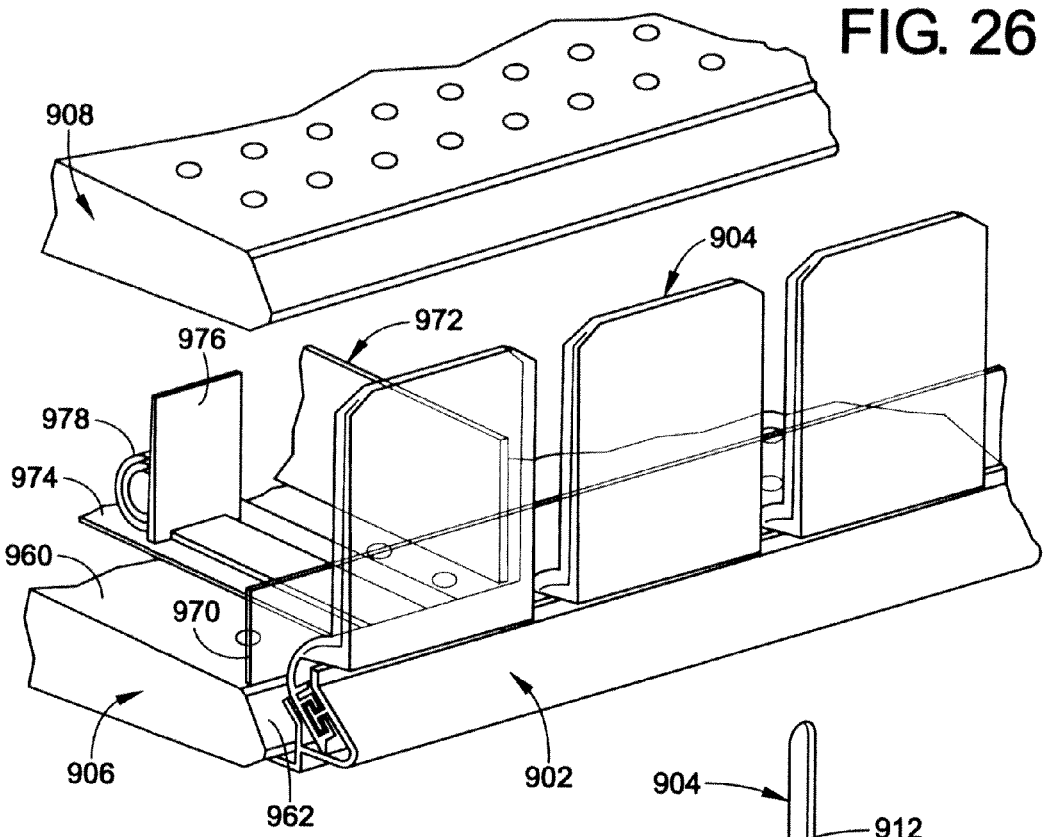
FIG. 26 is a perspective view of a sliding tile security system according to a seventh embodiment of the present disclosure.
Figure 27:
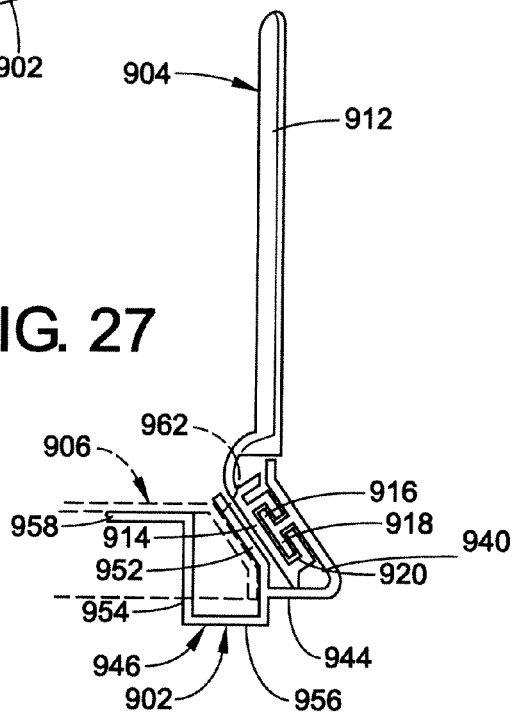
FIG. 27 is a side elevational view of the sliding tile security system of FIG. 26.

With reference now to FIGS. 26 and 27, an inverted tile rail design is there illustrated. In this design, a rail 902 is connected to a shelf. Extending upwardly from the rail are a plurality of slidable tiles 904. More particularly, the rail 902 is mounted to a lower shelf 906 and the tiles 904 extend upwardly towards an upper shelf 908. With reference now also to FIG. 27, the tiles 904 each include a front wall 912 and a foot 914, angled in relation to a plane of the front wall. Extending away from the foot 914 is a top flange 916 and a bottom flange 918, spaced therefrom. These two define between them a longitudinally extending slot 920.

The mounting rail 902 includes a front wall 940. Extending rearwardly from a rear face of the front wall 940 is a T-shaped protrusion 942. It is evident from FIG. 27 that the protrusion of the rail is accommodated in the slot 920 of the tile so as to interconnect these two elements. In this way, the tiles 904 can slide in relation to the rail 902 in a sideward manner so as to selectively expose a desired column of merchandise being held on the lower shelf 906. The rail 902 also includes a base wall 944, which is connected to the front wall 940. The base wall, in turn, is connected to a clip portion 946 of the rail 902. The clip portion includes a front leg 952, a rear leg 954 and a connecting leg 956. Also provided is a flange 958. The clip enables the rail 902 to be selectively mounted to the lower shelf 906. More particularly, the lower shelf 906 includes a top wall 960 and a front wall 962. The clip front leg 952 contacts the shelf front wall 962. The flange 958 of the clip contacts a bottom surface of the shelf top wall 960 in order to stabilize the rail in relation to the shelf and resiliently mount the rail securely to the shelf. In one embodiment, the rail 902 can be made from a suitable thermoplastic material. Alternatively, it could be made from metal.

With reference again to FIG. 26, a shelf management system can be mounted on the lower shelf 906. The shelf management system can include a front fence 970 which is suitably secured to the shelf top surface 960, as is known in the art. The shelf management system also includes one or more dividers 972 and one or more tracks 974. These can be suitably secured to the shelf 906 either via the front fence or directly. Each track can accommodate a pusher 976 which is slidably mounted thereon. Urging the pusher forwardly on its track is a conventional coil spring 978.

With reference now to FIG. 28, disclosed therein is another embodiment of a rail for mounting one or more sliding tiles to a shelf. In the embodiment disclosed, a rail 1002 accommodates on one face thereof an adhesive strip 1004. It should be apparent that the adhesive strip 1004 can extend the entire length of the rail 1002. The adhesive strip has a first or upper adhesive face 1006 which is meant to be adhered to a suitable surface on a conventional shelf (not illustrated in FIG. 28). The adhesive strip also includes a second adhesive face 1008 which is secured to one face of the rail 1002. As in the earlier designs, the rail 1002 includes a longitudinally extending slot 1010 which leads to a channel 1012. The channel is adapted to accommodate a cooperating protrusion of a suitable sliding tile. It should be appreciated that the adhesive face 1006 can be secured beneath a shelf so as to be adhered to a lower face of an upper shelf with tiles depending therefrom towards a lower shelf. Alternatively, the adhesive face 1006 can be secured to a vertically extending front face of a shelf with suitable tiles mounted thereto. As another alternative, the rail can be secured to a top face of a shelf with the tiles extending upwardly therefrom. In such a design, the rail 1002 could serve somewhat as a front fence for items which are being retailed on the shelf.

With reference now to FIG. 29, a still further embodiment of a rail is there illustrated. In this embodiment, a rail 1102 includes a front wall 1104, a top wall 1106 and a bottom wall 1108. Extending rearwardly from the top wall 1106 is a first clip 1112. Extending rearwardly from the bottom wall 1108 is a second clip 1114. The two clips are meant to accommodate suitable wires 1116 and 1118 of a wire rack type display system, which is known in the merchandising art.

Extending forwardly from the top wall 1106 is an upper T-shaped protrusion 1130. Extending forwardly from the front wall 1104 is a lower T-shaped protrusion 1132. The two protrusions define between them, a slot 1134 and a channel 1136. Mounted to the rail 1102 is a tile 1140. The tile includes a front wall 1142 and, extending rearwardly therefrom, a tab 1144. The tab includes a stem 1146 and a planar portion 1148. The stem protrudes through the slot 1134 of the rail 1102 and the planar portion 1148 is accommodated in the channel 1136 of the rail. With this design, the tile 1140 can slide laterally in relation to the rail 1102 so as to selectively make accessible any column of merchandise being retailed in the wire rack display of the merchant, by a suitable sliding motion of the tile in relation to the retail display.

Figure 30:
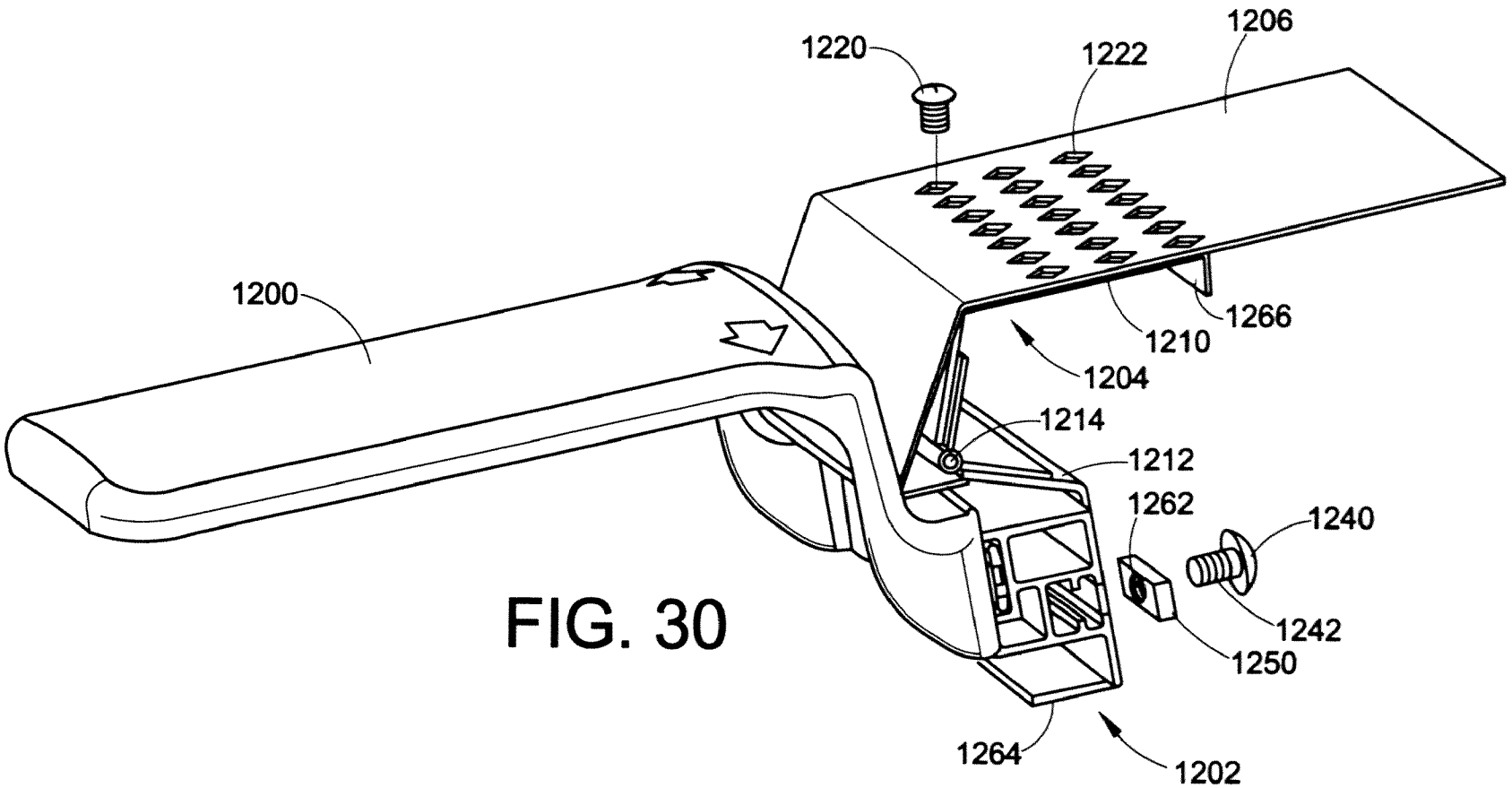
FIG. 30 is a perspective view of a sliding tile security system according to a ninth embodiment of the present disclosure.

With reference now to FIG. 30, disclosed therein is a sliding tile security system comprising one or more tiles 1200 slidably mounted to a rail 1202. A connecting element 1204 mounts the rail to a shelf 1206. More particularly, the connecting element comprises a first section 1210 and a second section 1212 which are pivotally mounted to each other via a suitable hinge, such as a piano hinge 1214. The first mounting section 1210 is secured via a threaded fastener 1220 to the shelf 1206. Suitable apertures 1222 are provided on the shelf for this purpose. The rail 1202 is secured to the second section 1212 of the connecting element 1204 via one or more fasteners 1240 which can have a threaded stem as at 1242. Each fastener 1240 can cooperate with a nut 1250 that is slid into a longitudinally extending slot 1252 defined in the rail 1202. A threaded aperture 1262 can extend through the nut 1250. In order to hold the rail 1202 in a use position, the rail can be provided with a flange 1264 which can cooperate with a flange 1266 of the first mounting member 1210 in a friction fit type arrangement.

Figure 31:
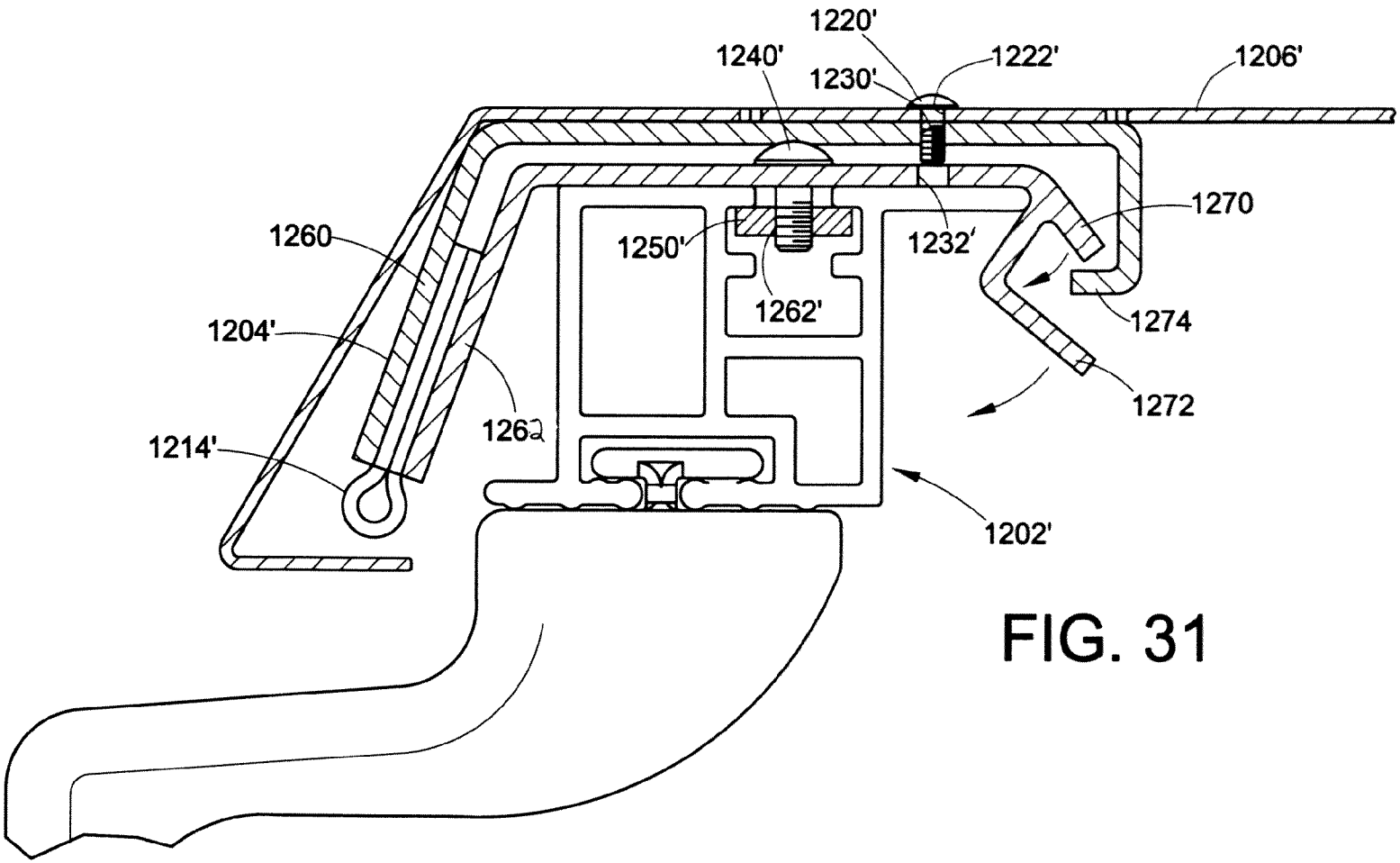
FIG. 31 is a side elevational view of a sliding tile security system according to a tenth embodiment of the present disclosure.

Another embodiment for selectively securing a rail in an operative position in relation to a shelf is illustrated in FIG. 31. It can there be seen that a rail 1202' is mounted to a shelf 1206' via a connecting element 1204'. In this embodiment, the connecting element comprises a first section 1260 and a second section 1262. As in the earlier embodiment, the two sections are connected via a piano hinge 1214' or the like. Also illustrated is a first fastener 1220' extending through an aperture 1222' in the shelf 1206' and an aligned threaded aperture 1230' provided in the first member 1260. If desired, an aligned opening 1232' can be provided in the second element 1262 in order to accommodate a distal end of the fastener 1220'. In this embodiment, the second member 1262 is provided with a flange 1270, as well as an actuating arm 1272. The flange 1270 cooperates with an L-shaped extension 1274 of the connecting element first section 1260 so as to selectively lock the two members 1260 and 1262 to each other. However, by suitable actuation of the arm 1272, the flange 1270 can be moved in relation to the L-shaped member 1274 so as to allow the hinge 1214' to pivot.

Figure 32:
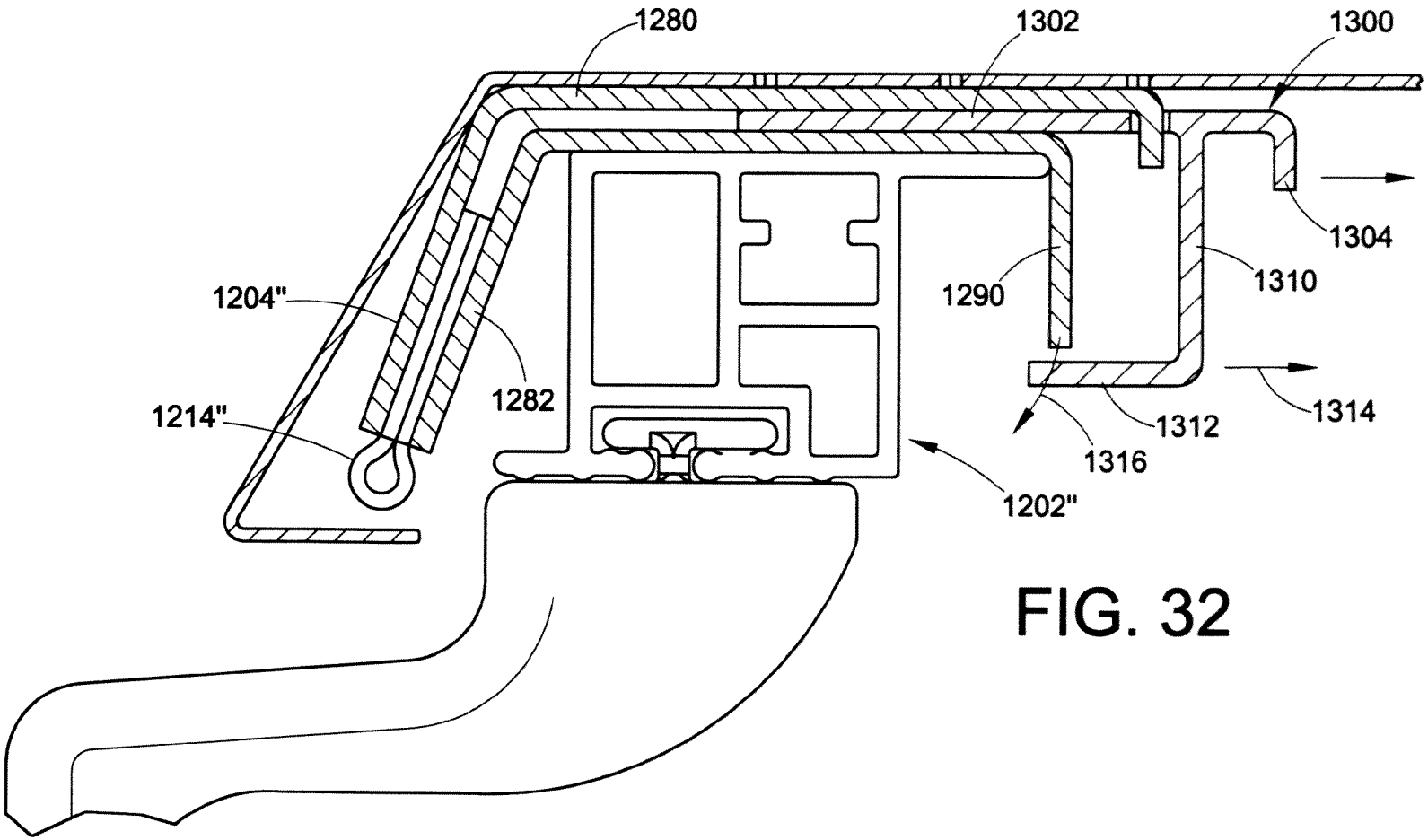
FIG. 32 is a side elevational view of an eleventh embodiment of a sliding tile security system according to the present disclosure.

A further embodiment of a locking feature is illustrated in FIG. 32. In this embodiment, a connecting member 1204" includes a first section 1280 and cooperating therewith a second section 1282. The two sections are connected by a hinge 1214". The second section is provided with an arm 1290. Also provided is a sliding lock 1300, which can be slidably mounted to the first section 1280. This lock includes a first wall 1302 which is provided with a finger access tab 1304 for manual actuation. Depending from the first wall 1302 is a second wall 1310. The second wall includes a flange 1312. The arm 1290 cooperates with the flange 1312 in a first end position of the sliding lock. However, as shown by the arrow 1314, a retraction of the sliding lock 1300 will enable the rail 1202" to pivot away from its use position, as illustrated by arrow 1316.

Figure 33:
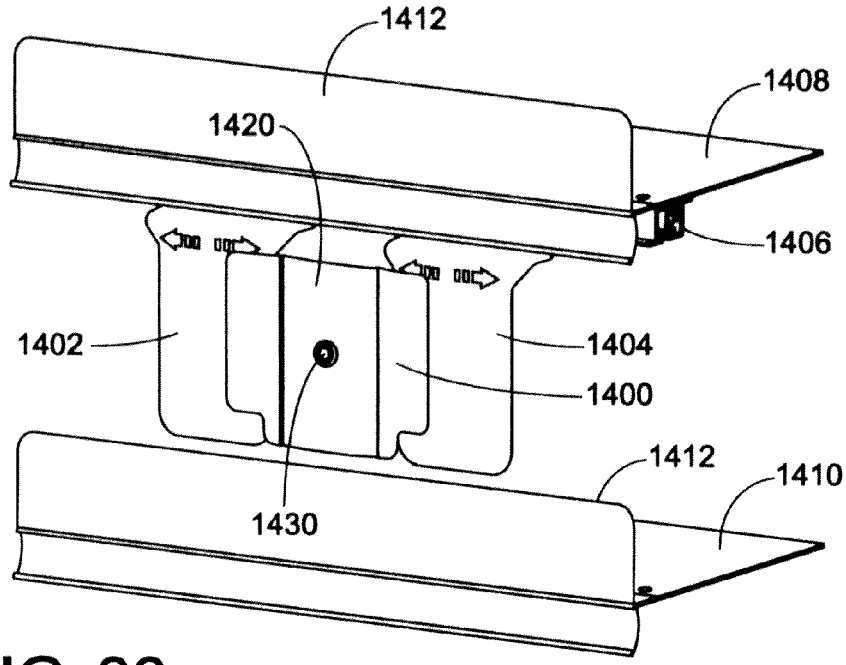
FIG. 33 is a front perspective view of a tile lock for a sliding tile security system according to the present disclosure.

With reference now to FIG. 33, another locking member is there illustrated for filling a gap or opening between two adjacent tiles. Such a locking member may be necessary when the merchant is closed in order to forestall any access to articles held on a shelf. In this design, there is provided a sliding tile lock 1400 positioned in an opening defined between a pair of adjacent tiles 1402 and 1404. The tiles can be supported by a rail 1406 attached to an upper shelf 1408 positioned above a lower shelf 1410. Both shelves can be provided with a conventional front fence 1412.

Figure 34:
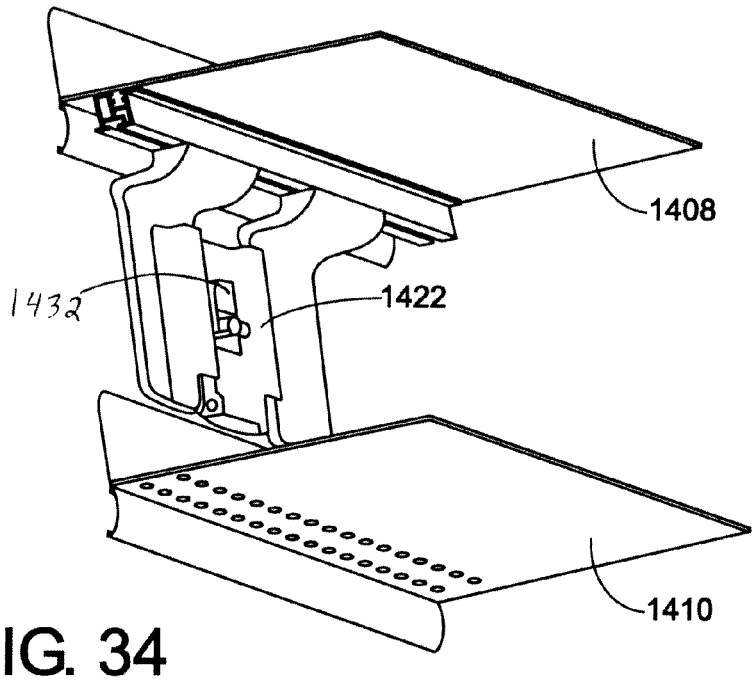
FIG. 34 is a rear perspective view of the system of FIG. 33.
Figure 35:
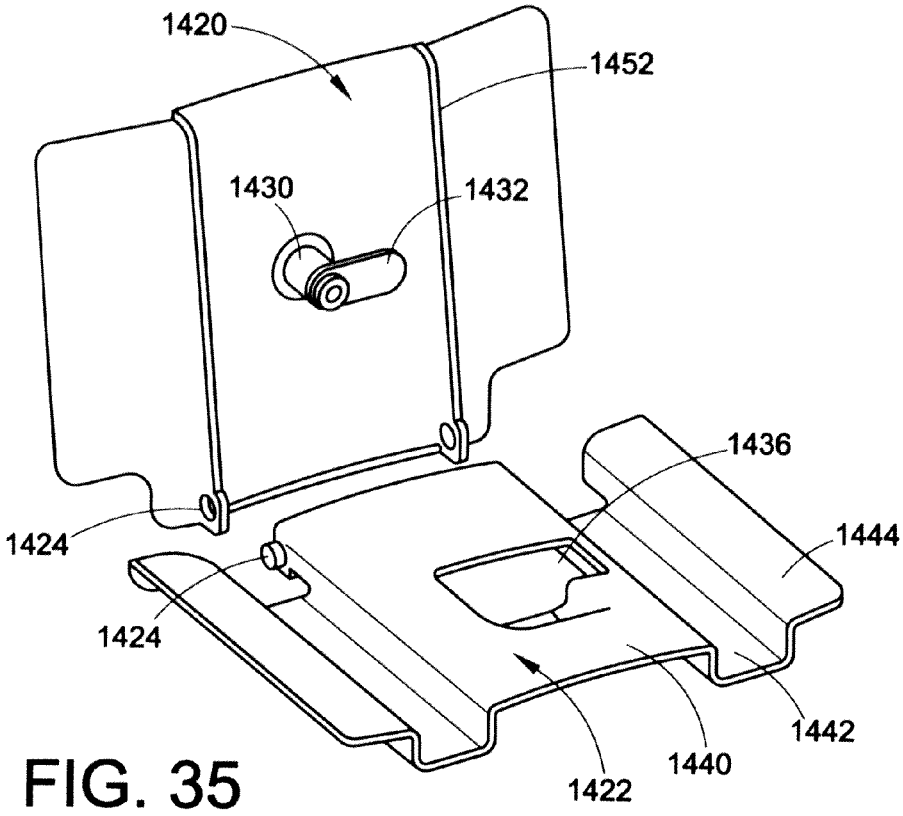
FIG. 35 is an exploded perspective view of the tile lock of FIG. 33; and, FIG. 36 is a top plan view of the tile lock in an assembled and locked position.

As shown in FIG. 35, the sliding tile lock 1400 can include a first section 1420 and a second section 1422. These two sections can be mounted together via suitable hinges 1424. Rotatably mounted to the first section is a lock 1430. The lock 1430 includes a distal arm 1432 which extends transversely to an axis of the lock. The distal arm cooperates with a raised portion 1434 of the lock second section 1422. Provided adjacent the section 1434 is a slot 1436 to accommodate the arm 1432 of the lock when it is in the unlocked position. As can be seen, the arm can rotate 90 degrees from the locked position shown in FIG. 34 to the unlocked position shown in FIG. 35.

Figure 36:
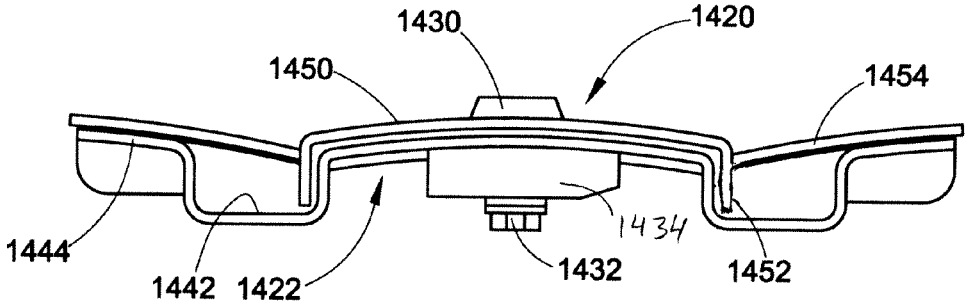

The second section 1422 can comprise a central portion 1440 delineated by respective channels 1442 from respective wings 1444. With reference now to FIG. 36, the first section 1420 includes a central portion 1450 and a pair of shoulders 1452 which are accommodated in the grooves 1442 of the second section. Also provided are a pair of wings 1454 which cooperate with the wings 1444 of the second section. The wings cooperate in order to trap between them the adjacent side portions of a pair of tiles, such as the tiles 1402 and 1404. With such a lock, the tiles are unable to move, since the opening between them has now been filled by the tile lock.

The present disclosure has been described with reference to several embodiments. Obviously, modifications and alterations will occur to others upon the reading and understanding of the preceding detailed description. It is intended that the present invention be construed as including all such modifications and alterations insofar as they come within the scope of the appended claims or the equivalents thereof.

What is claimed is:

1. A merchandise security system comprising:

a merchandise display including a first display member and a second display member vertically spaced from said first display member;

at least one tile mounted to the first display member, the at least one tile being moveable between a first position blocking access to a desired column of associated merchandise stored on one of said first and second display members to a second position allowing access to the desired column of the associated merchandise; and a lock member operatively connected to the at least one tile for restricting movement of the at least one tile from its first position;

wherein the lock member is moveable from a locked position, whereat the lock member interferes with movement of the at least one tile from its first position, to an unlocked position which enables the at least one tile to be moved from its first position to its second position for allowing access to the desired column of associated merchandise.

2. A merchandise security system as set forth in claim 1, wherein the at least one tile extends from the first display member towards the second display member when in the first position.

3. A merchandise security system as set forth in claim 1, wherein the lock member includes a finger access tab for manual actuation.

4. A merchandise security system as set forth in claim 1, wherein, when the lock member is in the locked position, a surface of the lock member blocks movement of a corresponding surface of the tile.

5. A merchandise security system as set forth in claim 1, wherein the at least one tile is pivotally attached to the first display member at a leading edge thereof by a hinge member.

6. A merchandise security system as set forth in claim 1, wherein the at least one tile comprises a plurality of tiles which are pivotally attached to the first display member along a common axis, each tile being moveable to provide selective access to a desired column of merchandise.

7. A merchandise security system for use with an associated display member for selectively providing access to a column of merchandise, comprising:

at least one tile mounted to an associated display member at a position in front of at least one column of associated merchandise supported above or below the display member, the at least one tile being moveable between a first position blocking access to the column of the associated merchandise and a second position allowing access to the column of the associated merchandise; and a lock member for restricting movement of the at least one tile from its first position;

wherein the lock member is operatively connected to the display member and is moveable relative to the at least one tile between a locked position where at the lock member interferes with movement of the at least one tile from its first position, and an unlocked position allowing the at least one tile to be moved between its first and second positions for allowing access to the desired column of the associated merchandise.

8. A merchandise security system as set forth in claim 7, wherein a face of the at least one tile is oriented substantially perpendicular to a longitudinal axis of the column of associated merchandise when the at least one tile is in the first position, and wherein the tile is oriented substantially parallel to and spaced apart from the longitudinal axis of the column of associated merchandise when the at least one tile is in the second position.

9. A merchandise security system as set forth in claim 8, further comprising a hinge member for hingedly securing an edge of the tile to the associated display member.

10. A merchandise security system as set forth in claim 7, wherein the lock member includes a finger access tab for manual actuation.

11. A merchandise security system as set forth in claim 7, wherein, when the lock member is in the locked position, a surface of the lock member blocks movement of a corresponding surface of the tile.

12. A merchandise security system as set forth in claim 7, further comprising a plurality of tiles pivotally attached to the associated display member along a common axis, each tile being moveable to provide selective access to a desired column of merchandise.

13. A merchandise security system comprising:

a plurality of tiles disposed in front of at least one associated shelf, each tile selectively blocking access to a column of associated product held on the at least one associated shelf;

a pivot joint connecting each tile of said plurality of tiles to the at least one associated shelf, so that each tile is selectively pivotable in relation to the at least one associated shelf; and wherein in a first position each tile retards access to the column of associated product held on the at least one associated shelf and in a second position each tile allows access to the column of associated product.

14. The merchandise security system of claim 13, further comprising a rail mounted to the at least one associated shelf wherein the pivot joint of each tile is connected to the rail.

15. The merchandise security system of claim 13, wherein a tile of the plurality of tiles extends from a first associated shelf towards a second associated shelf when the tile is in the first position.

16. The merchandise security system of claim 15 wherein the tile depends from the first associated shelf and approaches the second associated shelf.

17. The merchandise security system of claim 13, wherein the plurality of tiles extend along a common axis.

18. The merchandise security system of claim herein a first tile of the plurality of tiles includes a curved wall.

19. The merchandise security system of claim 18, wherein a portion of the curved wall is located in a first plane, the first plane being located in front of a second plane extending through the pivot joint of the first tile.

20. The merchandise security system of claim 13 wherein each tile of the plurality of tiles includes a first section disposed beneath the at least one associated shelf and a second section which is spaced forwardly from said first section so that it is disposed forwardly of the at least one associated shelf.

* * * * *